US010787958B2

(12) United States Patent
Pimentel

(10) Patent No.: US 10,787,958 B2
(45) Date of Patent: Sep. 29, 2020

(54) SYSTEM, METHOD, AND DEVICE TO OPTIMIZE THE EFFICIENCY OF THE COMBUSTION OF GASES FOR THE PRODUCTION OF CLEAN ENERGY

(71) Applicant: The Bluedot Alliance B.V., Amsterdam (NL)

(72) Inventor: Marcelo Fernando Pimentel, São Roque (BR)

(73) Assignee: The Bluedot Alliance B.V., Amsterdam (NL)

( * ) Notice: Subject to any disclaimer, the term of this patent is extended or adjusted under 35 U.S.C. 154(b) by 177 days.

(21) Appl. No.: 15/780,185

(22) PCT Filed: Nov. 30, 2016

(86) PCT No.: PCT/BR2016/050312

§ 371 (c)(1),
(2) Date: May 30, 2018

(87) PCT Pub. No.: WO2017/091880

PCT Pub. Date: Jun. 8, 2017

(65) Prior Publication Data

US 2018/0363542 A1 Dec. 20, 2018

(30) Foreign Application Priority Data

Nov. 30, 2015 (BR) ..... 102015030045

(51) Int. Cl.
*F02B 43/04* (2006.01)
*F02M 27/04* (2006.01)
(Continued)

(52) U.S. Cl.
CPC ..... *F02B 43/04* (2013.01); *F02B 43/12* (2013.01); *F02M 27/045* (2013.01); *F23C 99/001* (2013.01); *F23K 2400/10* (2020.05)

(58) Field of Classification Search
CPC ..... F02M 27/04; F02M 27/045; F02M 2027/047; F23K 2301/101; B01J 19/087;
(Continued)

(56) References Cited

U.S. PATENT DOCUMENTS 3,669,274 A * 6/1972 Happ ..... C02F 1/481 210/222
4,357,237 A * 11/1982 Sanderson ..... B03C 1/28 210/222
(Continued)

FOREIGN PATENT DOCUMENTS

CA 2240016 A1 * 12/1999 ..... E21B 37/00
CN 103032213 A * 10/2013 ..... F02M 27/04
(Continued)

OTHER PUBLICATIONS https://nationalmaglab.org/about/around-the-lab/meet-the-magnets/meet-the-100-tesla-pulsed-magnet. (Year: 2015).*
(Continued)

*Primary Examiner* — Jacob M Amick
*Assistant Examiner* — Michael A Kessler
(74) *Attorney, Agent, or Firm* — Alston & Bird LLP

(57) ABSTRACT

The present invention refers to a system, a method and a device to optimize the efficiency of the combustion of gases for the production of clean energy comprising a magnetic nucleus (30) and inlet and outlet ducts (41*a*, 42*a*), the inlet and outlet ducts (41*a*, 42*a*) being configured to receive gases, the gases alternately establishing flows between the inlet ducts (41*a*) and the outlet ducts (42*a*) and vice-versa, the magnetic nucleus (30) being configured to generate and to expose the gases within the inlet and outlet ducts (41*a*, 42*a*) to magnetic fields (35), the alternation of flows between the inlet and outlet ducts (41*a*, 42*a*) and the exposure to magnetic fields (35) promoting acceleration of the hydrogen
(Continued)

atoms and ions of oxygen and argon, promoting the reduction of the radii of the orbits of the electrons of the hydrogen around their nuclei and provoking the release of potential energy of the electrons and corresponding increase of the kinetic energy of the nuclei of the gas molecules, in such a way to optimize (increase) the heating power of the gases (201, 202).

25 Claims, 10 Drawing Sheets

(51) Int. Cl.
*F23K 5/10* (2006.01)
*F02B 43/12* (2006.01)
*F23C 99/00* (2006.01)

(58) Field of Classification Search
CPC ..... B01J 2219/0852; B01J 2219/0854; B01J 2219/0856; B01J 2219/0862; C01B 3/042; C01B 3/045; Y02E 60/366; Y02T 10/126; B01D 2259/814; C02F 1/481; F02B 43/10; F02B 2043/10
USPC ..... 210/222, 695; 123/536, 538
See application file for complete search history.

(56) References Cited

U.S. PATENT DOCUMENTS 4,372,852 A 2/1983 Kovacs
4,568,901 A 2/1986 Adam
4,995,425 A 2/1991 Weisenbarger et al.
5,076,246 A 12/1991 Onyszczuk
5,161,512 A 11/1992 Adam et al.
5,637,226 A 6/1997 Adam et al.
5,943,998 A 8/1999 Brown et al.
6,024,935 A 2/2000 Mills et al.
6,851,413 B1 2/2005 Tamol, Sr.
6,972,118 B2 * 12/2005 Santilli ..... B01J 7/00 204/164
8,444,853 B2 5/2013 Popov
8,517,000 B2 * 8/2013 Rowland ..... F02M 27/045 123/536
2003/0168393 A1 * 9/2003 Tsunematsu ..... C02F 1/481 210/222
2004/0238514 A1 * 12/2004 Scali ..... F02M 27/045 219/202
2008/0290038 A1 11/2008 Kaitting et al.
2011/0104793 A1 * 5/2011 Grange ..... H05B 6/70 435/283.1
2012/0067802 A1 * 3/2012 Irvin ..... B03C 1/0332 210/222
2014/0130756 A1 * 5/2014 McAlister ..... F02B 43/00 123/1 A
2014/0144826 A1 5/2014 Mason
2015/0233285 A1 * 8/2015 Beraldo ..... C01B 3/042 123/3
2015/0252757 A1 * 9/2015 McAlister ..... F02M 27/042 123/297

FOREIGN PATENT DOCUMENTS

DE 202006015219 U1 2/2007
DE 202007001730 U1 4/2007
EP 0689869 A1 1/1996
EP 2907788 A1 8/2015
FR 2947011 A1 12/2010
JP S6477743 A 3/1989
WO WO 2010/033171 A1 3/2010
WO WO 2010/146307 A1 12/2010

OTHER PUBLICATIONS https://www.smithsonianmag.com/smart-news/strongest-indoor-magnetic-field-blows-doors-tokyo-lab-180970436 (Year: 2018).*
International Preliminary Examining Authority, Written Opinion (Second), including Applicant's Sep. 27, 2017 Response to the ISA's Mar. 6, 2017 Written Opinion, for International Application No. PCT/BR2016/050312, dated Mar. 22, 2018, 8 pages, European Patent Office, The Netherlands.
International Searching Authority (ISA), International Search Report and Written Opinion for International Application No. PCT/BR2016/050312, dated Mar. 6, 2017, 12 pages, European Patent Office, The Netherlands.
Mills, R. L., et al., "Commercializable power source using heterogeneous hydrino catalysts", *International Journal of Hydrogen Energy*, 2010, pp. 395-419, vol. 35, Elsevier, Ltd., UK.

* cited by examiner

SYSTEM, METHOD, AND DEVICE TO OPTIMIZE THE EFFICIENCY OF THE COMBUSTION OF GASES FOR THE PRODUCTION OF CLEAN ENERGY

CROSS REFERENCE TO RELATED APPLICATIONS

This application is a National Stage Application, filed under 35 U.S.C. 371, of International Application No. PCT/BR2016/050312, filed Nov. 30, 2016, which claims priority to Brazilian Application No. BR102015030045-0, filed Nov. 30, 2015; the contents of both of which are hereby incorporated by reference in their entirety.

BACKGROUND

Related Field

The present invention falls within the area of green technologies, more specifically alternative "clean" and "green" energies. Specifically, the present invention uses fuel cells that produce non-polluting gases that can be used in vehicles fueled by hydrogen or in currently existing motor vehicles, replacing the use of fossil fuels with a mixture of optimized oxyhydrogen (HHO).

The present invention refers to a system, method and device to optimize the efficiency of the combustion of gases for the production of clean energy, from gases that contain hydrogen in their composition, in particular a mixture of oxyhydrogen gases (HHO).

The present invention has been developed to promote the significant gain in the efficiency in the burning of hydrogen gas and for its use in conjunction with different devices that convert thermal energy into other types of energy, such as internal combustion engines, generators and turbines. The present invention can also be used together with devices that use thermal energy for heating or the production of vapor, such as furnaces or boilers.

It is important to note that the use of hydrogen gas as a source of energy has the potential to respond to the urgent search for an alternative source of clean, low cost and abundant energy. Taking into account that the combustion process of the hydrogen results only in water vapor, it can be observed that this is a viable alternative source to be used in the place of the burning of hydrocarbons. The combustion of hydrogen totally eliminates polluting gas emissions, the so-called greenhouse gases, and this is the fundamental objective of the proposed invention.

Description of Related Art

To stabilize the atmospheric concentration of greenhouse gases to avoid a catastrophic interference in the climatic system is the great challenge of the XXI century. The $CO_2$ emissions arising from the burning of fossil fuels contribute to approximately 78% of the total of the current anthropogenic greenhouse gas emissions (IPCC report). In the absence of policies of mitigation and a radical transition towards clean energies, the growth of the emissions shall persist, resulting in an increase in temperature of between 3.7° C. to 4.8° C. by the end of the century. It is necessary to understand the magnitude of the warning by scientists about the probability and the scale of the environmental impacts and the social, economic and geodemographic nature of this scenario.

In 2014, renewable energy sources contributed only 3% of the total energy consumed in the world, despite significant investments made in this sector in the last two decades. Fossil fuels are dominant and supply more than 85% of the global demand for energy (BP Statistical Review of World Energy 2015).

Based on the estimates of the US International Energy Association, the global demand for energy will increase by more than 50% by 2040, due to population growth, aligned with the increase in global purchasing power and international efforts to combat poverty. According to the United Nations, more than 1.3 billion people still do not have access to electricity, and more than 1 billion only have access to non-reliable networks. The democratization of energy and universal access to electricity are indispensable in order for the new cycles of economic developments to take place.

Currently, the largest energy sources are also the largest sources of $CO_2$. The precise impact of these emissions on the world climate is still uncertain but scientific consensus states that the poorest populations will be the most vulnerable to the extreme effects of global warming, despite contributing little to the problem.

In 2015, COP 21, also known as the Paris Climate Conference, achieved an unprecedented universal agreement containing commitments to reduce the emissions of 187 countries. The result of this agreement is a critical turning point that will redefine climatic actions for the next decades, with the objective of maintaining global warming to a level of less than 2° C.

The energy required for the next decades should not only be low cost, but the climatic challenges of this century require a rapid transition towards clean technologies. One of the great potential applications of the present invention is in the sector of electricity generation, both in thermoelectric plants, the largest source of electricity in the world, and in autonomous systems of renewable energy destined for communities that do not have access to electricity distribution networks.

The transport sector is currently the most dependent on fossil fuels. This market has been modifying rapidly due to government initiatives to improve the efficiency of fuel and also as a result of the demand by consumers for more sustainable vehicle alternatives. Automobiles that use gasoline or diesel constitute approximately 98% of the world fleet. Technological developments such as electric cars and cars that use fuel cells have received great emphasis in recent years. Despite this, their presence in the world fleet is still inexpressive. Finally, even electric vehicles that store electricity in batteries continue to be potential polluters and innocuous regarding the combat for the reduction of greenhouse gas emissions, depending on how the electrical energy stored in them is produced.

It has to be mentioned that patent documents referring to devices that have the objective to increase efficiency in the burning of fuel (in general liquids) based on their exposure to magnetic fields exist in their hundreds. The greatest evidence, however, of the low effectiveness of the existing solutions is the fact that none of them have succeeded, up to now, in relevant public acceptance. To prove this assertion is the fact that even today, dozens of years after their appearance, no vehicle leaves a factory with these solutions, despite the enormous commitment of the automobile industry to produce more economical and less polluting vehicles, and even to satisfy a rigorously growing legislation regarding emissions of polluting gases.

An example of this solution is described in U.S. Pat. No. 8,444,853, which refers to a device for the magnetic treatment of a fluid with the objective of improving the burning of fuel. However, it can be observed that this document does not describe or suggest the combustion of hydrogen as proposed in the present invention.

Other solutions are described in U.S. Pat. Nos. 5,637,226 and 5,943,998, which refer to the magnetic treatment of fluids to improve fuel combustion. Similarly, it can be observed that these documents do not describe or suggest the combustion of hydrogen as proposed in the present invention.

Similarly, Patent documents U.S. Pat. No. 6,851,413, US 2014/0144826, US 2008/0290038, U.S. Pat. Nos. 5,943,998, 5,161,512, 4,372,852, 4,568,901 and 4,995,425 refer to the magnetic treatment of fuel with the objective of improving the fuel combustion. However, it can be observed that these solutions do not describe or suggest the combustion of hydrogen as proposed in the present invention.

Although the devices described in the above documents have potentially large scale application, these devices only have the objective to reduce the consumption of traditional fossil fuels, in modest levels, through greater efficiency in their redox (burning) in internal combustion engines. The quoted efficiency improvement ranges (typically less than 10%) are rarely corroborated in practice, as remains proven by the virtual absence of these devices in large scale commercial applications, whether equipping new vehicles or in the spare parts market (after markets).

The U.S. Pat. No. 6,024,935 refers to the production of thermal energy based on hydrogen and has a source of principles that are analogous to those that form the basis for the present invention. However, this involves a complex process, concerning an operation with high temperatures and a sophisticated mechanical assembly, making use of proprietary chemical compounds as catalyzers and with a high cost compared to the present invention, resulting in a high degree of difficulty for its implementation and reproduction. These claims are evidenced by the fact that up to now, almost 20 years after its publication, it has still not succeeded in entering into commercial operation.

Therefore, there is a clear necessity for an invention that has the objective of not only a modest potential reduction in the use of fossil fuels, but also a substantial reduction (percentages above 30%) or even the complete substitution of fossil fuel (the entire chain of hydrocarbons) by clean fuels such as hydrogen, whose burning produces only water vapor.

Based on the foregoing, it can be observed that the present invention differentiates itself from the myriad of other patent documents that use magnetic fields to increase efficiency in the burning of fuel (in general liquids). More specifically, the present invention deals specifically with gases, to the contrary of what occurs in the state of the art, and these gases contain hydrogen in their composition.

It is important to highlight that the present invention promotes a continued and repetitive exposure of the molecules of these gases to magnetic fields of variable intensity, orientation, direction and polarity, combining this exposure with processes of acceleration of movement, volumetric expansion and temperature gain and repeating this conditioning cycle for a sufficient number of times, in order that the magnitude of the gains of energetic efficiency are maximized and the obtained gain is maintained stable for a sufficient time until the combustible gas can be used in a subsequent redox process.

In order to overcome the problems of the state of the art, the device that is the object of the present invention was developed, based on the knowledge of atomic models and of quantum thermodynamics, as highlighted below:

In 1913, the Danish physicist, Niels Bohr, developed a theory to explain the atomic model previously proposed by Rutherford. This new model considers the quantum theory of Max Planck to explain the stability of matter and the emission of the spectrum in defined radii in each element. The Bohr model describes the atom as a nucleus with a positive charge surrounded by electrons that flow in a circular trajectory around the nucleus, with the attraction exercised by electrostatic forces.

This model, although flawed for heavier atoms, perfectly explained the phenomenon such as the emission spectrum and the absorption of hydrogen. Hydrogen is a unique atom in the universe and it is the simplest atom that exists: its nucleus has only one proton and only one electron orbiting around this nucleus. To explain the evident stability of the hydrogen atom and also the appearance of the series of spectral lines of this element, Bohr proposed some "postulates".

1) The electron moves around the nucleus in a circular orbit, as a satellite moves around a planet, maintaining this orbit at the cost of the attractive electrical force between charges with opposite signs.

2) The circular orbit of the electron cannot have any radius. Only certain values are allowed for the radii of the orbits.

3) In each allowed orbit, the electron has a constant and well defined energy, given by: E=E1/n2, where E1 is the energy of the minimum radius orbit. Bohr gave a formula for E1: in relation to the negative sign in this formula, it can be observed that the smaller the "n", the more internal is the orbit (the smaller the radius) and the more negative is the energy of the electron. Physicians use negative energies to indicate that something is linked, "confined" to some region of the space.

4) While it is on one of its allowed orbits, the electron does not emit or receive any energy.

5) When an electron changes orbit, the atom emits or absorbs a "quantum" of energy. Various scientists have researched these transitions at different levels.

Quantum field theory (QFT) is a set of ideas and mathematical techniques used to describe quantum physical systems that have an infinite number of degrees of freedom. The theory provides the theoretical structure used in several areas of physics, such as the physics of elementary particles, cosmology and the physics of condensed matter.

The archetype of quantum field theory is Quantum Electrodynamics (traditionally abbreviated as QED "Quantum Electrodynamics"), which essentially describes the interaction of electrically charged particles through the emission and absorption of photons.

Within this paradigm, in addition to the electromagnetic interaction, both the weak interaction and the strong interaction are described by quantum field theories, which when combined form what is known as the Standard Model. This considers both the particles that compose the matter (quarks and leptons) and the mediating particles of forces such as excitations of fundamental fields, such as the magnetic fields used by the magnetic nucleus of the present invention.

The total energy present in an atom (of hydrogen) is given by the equation $E_T=E_P+E_K$, where: $E_T$=Total Energy, $E_P$=Potential Energy and $E_K$=Kinetic Energy. The potential energy $E_P$ is a function of the radius of orbit of the electron around the nucleus (of a single proton, in the case of hydrogen) and the kinetic energy $E_K$ is a function of the resultant vector of the movement speed of the nucleus of the atom.

Although still lacking generalized acceptance by the scientific community, there is large spectrum of data from scientific investigations that clearly and consistently suggests that hydrogen can exist in energetic states lower to those that were previously imagined possible, or in its ground level, i.e. with its electron in the orbit of a principal quantum number n=1 (Commercializable power source using heterogeneous hydrino catalysts, International Journal of Hydrogen Energy, volume 35, pages 395-419, 2010, R. L. Mills, K. Akhtar, G. Zhao, Z. Chang, J. He, X. Hu, G. Chu, http://dx.doi.org/10.1016/j.ijhydene.2009.10.038).

Hydrogen in lower than ground level energy state (i.e. with an orbit of atomic number <1), also called atomic hydrogen in a fractional Rydberg state, is represented by the formula $$Hf(n), \text{ where } n = \frac{1}{2}, \frac{1}{3}, \frac{1}{4}, \ldots \frac{1}{p} \quad (p \leq 137),$$

replaced the known parameter n=integer, in the Rydberg equation for excitation states of hydrogen. Hydrogen in a lower than ground level state carries less potential energy than hydrogen in natural state and its electron, when transiting from a higher energy orbit to a lower energy orbit, releases one or more quantums of energy, consequently accelerating the movement speed of the nucleus of the atom, by the principle of the conservation of energy (First Law of Thermodynamics).

R. L. Mills states that the transitional process of energetic state to lower than ground levels happens in the presence of catalyst agents, which firstly receive the quantum of energy released during the reduction of radius of the orbit of the electron and subsequently transfer this same quantum of energy to other bodies, in this case the hydrogen atom's own nucleus. According to Mills, in a favorable environment, for each collision between a catalyst ion and a hydrogen atom, the electron experiences a reduction in the radius of its orbit equivalent to a reduction of one level of atomic number, migrating from the orbit with a radius corresponding to its existing atomic number to the orbit with a radius corresponding to the atomic number immediately below and adjacent. Mills also highlights that among the several elements that serve as catalyzers, ionized oxygen ($O^{++}$) has a particular and unique behavior that establishes that this ion has the capacity, when in shock with the hydrogen atom, to cause the reduction of two quantum levels in the radius of the orbit of the hydrogen electron, instead of a single quantum level. That is, the oxygen ion is capable of making, for example, an electron with an orbit of radius n=½ to pass immediately to an orbit of radius n=¼ instead of the intermediary and adjacent level of n=⅓, releasing a greater amount of energy in this process (equivalent to the reduction of two quantum levels in the orbit of the electron).

Also according to R. L. Mills, different catalyzers have different capacity to cause one or more levels of reduction in the quantum numbers of the electron's orbits, such as the examples presented in the table below (only a few, there are several others), where the column m represents the number of levels of reduction in the orbit of the electron that the catalyzer causes in each collision:

| Catalyzer | m | Comment |
|---|---|---|
| $Ar^{+}$ | 1 | Argon Ion (Argon constitutes approximately 1% of the air) |
| $O^{++}$ | 2 | Oxygen Ion (lost two electrons) |
| K | 3 | Potassium Atom |
| Fe | 3 | Iron Atom |

The present invention uses the above described teachings, through the passage of a mixture of electrolytic hydrogen and electrolytic oxygen (oxyhydrogen—HHO) and ionized air through high intensity magnetic and electromagnetic fields, in a sequencing configuration of magnetic fields of particular properties, acceleration chambers, volumetric expansion and exchange of heat in the hydrogen atoms and ions of the present catalyzers (electrolytic oxygen, oxygen and argon present in the ionized air) causing the reduction of the energy state of the hydrogen atoms to lower than ground levels, at a temperature slightly above room temperature (approximately 55° to 65° C.) low pressure (approximately 60 mmHg), consistently, safely and at low cost.

Based on the above theory, it can be observed that from the division of molecules of $H_2O$ into $H_2$ and $O_2$ by electrolysis, oxyhydrogen is produced. These gases are then used by the device that is the object of the present invention, which has the function to make the radius of the positive and negative orbit of the hydrogen molecules (or of the hydrogen present in heavier chains of hydrocarbons) to be potentially altered by the collision of hydrogen molecules with ions of oxygen ($O^{++}$) and argon ($Ar^{+}$), which serve as catalyzers in the migration process of the hydrogen atoms to lower energy states, including lower than ground level states (orbits with fractional quantum numbers, with $$n = \frac{1}{2}, \frac{1}{3}, \frac{1}{4}, \ldots, \frac{1}{p} \text{ where } p \leq 137).$$

Such an alteration results in the release of potential energy in their transition orbits transformed into kinetic energy, which generates an expansion in the volume of the gases and maintains this condition momentarily stable.

This alteration is performed by means of the flow of the gases through several inlet and outlet ducts, dynamic and thermal expansion and the magnetic exposure until the output to an inlet duct in the explosion chamber, for example, of the internal combustion engine of an automobile.

In relation to the dynamic expansion, it can be observed that the gases pass through a plurality of inlet and outlet ducts, passing through smaller diameter orifices that cause the acceleration of the movement of their hydrogen molecules and the ions of oxygen and argon present in the ionized air. Passing through the orifice, the gases enter a chamber with a larger diameter and volume, where their molecules are once again conducted to another chamber where they are heated. Subsequently, the gas molecules continue through the circuit of ducts and pass through another orifice where once again they are submitted to the same process of acceleration, expansion and exchange of heat, and thereby successively until their output.

In relation to the thermal expansion, it can be observed that when the hydrogen passes through the orifice that remains in the dynamic expansion chamber, this is heated to approximately 60° C., in such a way that both the hydrogen molecules and the ions of oxygen and argon, which are mixed at this time, are exposed to thermal and volumetric gain, because the volume of the two elements increases with the heating. This phase also repeats several times during the process until the output.

In relation to the magnetic exposure, it can be observed that the hydrogen atoms have their + and – orbits determined by a magnetic force and the radius of this orbit defines their gain or loss of energy in that the greater the magnetic action around this orbit, the greater is the reduction of its radius and, as a consequence, the quantity of energy released in the transitions of the electrons between the orbits. For this purpose, the gases pass through the plurality of inlet and outlet ducts and by the orifices in the dynamic expansion chambers countless times. For each expansion, the orbits pass through 42 magnetic fields of variable intensity, orientation, direction and polarity distributed in three magnetic bars with 14 fields each, which are housed in the magnetic nucleus of the device that is the object of the present. To guarantee the efficiency of the process, the hydrogen electrons are subjected to the magnetic fields that promote the acceleration of the hydrogen atoms and ions of oxygen and argon and the transitional processes that result in the release of the quantums of energy during the migration of the electron from one orbit of a greater radius to an orbit of a smaller radius and the transformation of potential energy of the electrons into kinetic energy of the nuclei of the molecules of the hydrogen gas.

Among the main advantages in using the present invention, it is important to highlight that it almost instantaneously uses the produced oxyhydrogen. For example, in an electrolysis cell, intermediary storage is not necessary, in such a way that the device allows much greater safety and much less complexity, in relation to the solutions currently available in the market, which use the combustion of the hydrogen stored in high pressure tanks.

BRIEF SUMMARY

A first objective of the present invention is to increase substantially the efficiency of the combustion of the hydrogen gas, increasing its heating power and reducing the quantity of volume of gas necessary to perform functional and commercial purposes.

A second objective is to eliminate the emission of polluting gases and of gases that contribute to global warming, in particular $CO_2$ and the nitrogen oxides (NOx's), ordinarily present in the burning of fossil fuels. The invention will use a source of clean and abundant energy, seeking to guarantee the preservation of the environment and of the global ecosystem.

A third objective is an increase in safety in the use of the hydrogen fuel, dispensing with its prior storage. The use of the invention does not require storage of the hydrogen gas in potentially explosive high pressure cylinders. A few grams of hydrogen, produced by a conventional electrolytic cell, are sufficient for use in several applications, and can be used at the time of production, eliminating risks in the handling and storage of the gas.

A fourth objective is to provide a device to optimize clean fuel for use in conjunction with equipment that converts thermal energy into others types of energy, such as engines, power-generators and turbines.

A fifth objective is to provide a device to optimize clean fuel for the electrical energy generation sector and the industrial sector. The invention can be used with equipment that uses thermal energy for heating or the production of vapor, such as furnaces or boilers.

A sixth objective is to democratize the access to a source of clean and self-sustainable energy in regions where the access to the electrical grid is limited or non-existent. Among the potential beneficiaries are 18% of the world population who currently remain off-grid.

A seventh objective is to facilitate and accelerate the transition of the global economy to one based on hydrogen, which is the most abundant element in the universe and extensively present in all the regions of the planet. The easy access to this fuel will limit the necessity of investments in complex infrastructures for the extraction and distribution of energy.

The objectives of the present invention are achieved by means of a device to optimize the efficiency of the combustion of gases for the production of clean energy comprising a magnetic nucleus and inlet and outlet ducts. The inlet and outlet ducts are configured to receive gases and the gases alternately establishing flows between the inlet ducts and the outlet ducts and vice-versa. The magnetic nucleus is configured to generate and expose the gases within the inlet and outlet ducts to magnetic fields. The alternation of flows between the inlet and outlet ducts and the exposure to magnetic fields promote dynamic and thermal expansions and the magnetic exposure of the gases. This accelerates the hydrogen atoms and ions of oxygen and argon present in the ionized air, with a view to reducing the orbit radii of the electrons of the hydrogen atoms and promotes the production of modified hydrogen to lower than ground level energy states.

The objectives of the present invention are also achieved by means of a system to optimize the efficiency of the combustion of gases for the production of clean energy comprising a device to optimize the efficiency of the combustion of gases for the production of clean energy and a generating device of mechanical energy. The device to optimize the efficiency of the combustion of gases for the production of clean energy has inlet and outlet ducts and a magnetic nucleus. The inlet and outlet ducts are configured to receive gases and the gases alternately establish flows between the inlet ducts and the outlet ducts and vice-versa. The magnetic nucleus is configured to generate and expose the gases within the inlet and outlet ducts to magnetic fields. The alternation of flows between the inlet and outlet ducts and the exposure to magnetic fields promote dynamic and thermal expansions and the magnetic exposure of the gases. This accelerates the hydrogen atoms and ions of oxygen and argon present in the ionized air, with a view to reducing the orbit radii of the electrons of the hydrogen atoms and promote the production of modified hydrogen to lower than ground level energy states. The modified hydrogen with lower than ground level energy states flows to the mechanical energy generating device.

Additionally, the objectives of the present invention are also achieved by means of a method to optimize the efficiency of the combustion of gases for the production of clean energy comprising of the stages of:

- establish alternate flows of gases between inlet ducts and outlet ducts and vice-versa, in such a way to expand the gases dynamically;
- expand the gases thermally to each flow between the inlet ducts and the outlet ducts; and
- expose the gases magnetically to magnetic fields to each flow between the inlet ducts and the outlet ducts and vice-versa.

The objectives of the present invention are also achieved by means of a device to optimize the efficiency of the combustion of gases for the production of clean energy comprising of:

an expansion chamber;

a heating tower;

a magnetic nucleus;

a set of inlet ducts; and a set of outlet ducts, the sets of inlet and outlet ducts have a plurality of inlet and outlet ducts that extend adjacently around the external surface of the magnetic nucleus, the sets of inlet and outlet ducts are concentric to the magnetic nucleus, the set of inlet ducts establishes a fluidic communication with the expansion chamber and a thermal communication with the heating tower, the expansion chamber establishes a fluidic communication with the set of outlet ducts, the set of outlet ducts establishes a fluidic communication with the set of inlet ducts, in such a way that:

the inlet and outlet ducts receive gases, the gases alternately establish flows between the inlet ducts and the outlet ducts and vice-versa, the magnetic nucleus is configured to generate and expose the gases within the inlet and outlet ducts to magnetic fields, the alternation of flows between the inlet and outlet ducts promote the dynamic expansion of the gases when they flow through the expansion chamber, the thermal expansion of the gases when they flow through the heating tower and the exposure of the gases to magnetic fields generated by the magnetic nucleus, the dynamic and thermal expansions and the magnetic exposure accelerate the hydrogen atoms and the ions of oxygen and argon present in the ionized air to obtain the reduction of the radius of the orbit of the electrons of the hydrogen atoms and the consequent reduction of the potential energy of the electrons and the corresponding increase of the kinetic energy of the nuclei of the hydrogen atoms.

The objectives of the present invention are also achieved by means of a system to optimize the efficiency of the combustion of gases for the production of clean energy comprising of:

a device to optimize the efficiency of the combustion of gases for the production of clean energy; and a mechanical energy generating device, the device to optimize the efficiency of the combustion of gases for the production of clean energy has sets of inlet and outlet ducts that have a plurality of inlet and outlet ducts that extend adjacently around an external surface of a magnetic nucleus, the sets of inlet and outlet ducts are concentric to the magnetic nucleus, the set of inlet ducts establish a fluidic communication with an expansion chamber and a thermal communication with a heating tower, the expansion chamber establishes a fluidic communication with the set of outlet ducts, the set of outlet ducts establishes a fluidic communication with the set of inlet ducts, in such a way that:

the inlet and outlet ducts receive gases, the gases alternately establish flows between the inlet ducts and the outlet ducts and vice-versa, the magnetic nucleus is configured to generate and expose the gases within the inlet and outlet ducts to magnetic fields, the alternation of flows between the inlet and outlet ducts promotes the dynamic expansion of the gases when they flow through the expansion chamber, the thermal expansion of the gases when they flow through the heating tower and the exposure of the gases to magnetic fields generated by the magnetic nucleus, the dynamic and thermal expansions and the magnetic exposure accelerate the hydrogen atoms and the ions of oxygen and argon present in the ionized air to obtain the reduction of the radius of the orbit of the electrons of the hydrogen atoms and the consequent reduction of the potential energy of the electrons and corresponding increase of the kinetic energy of the nuclei of the hydrogen atoms, the optimized gases then flowing to the mechanical energy generating device.

Finally, the objectives of the present invention are achieved by means of a method to optimize the efficiency of the combustion of gases for the production of clean energy comprising of the following stages:

- to arrange sets of inlet and outlet ducts adjacently around an external surface of a magnetic nucleus;
- to establish a fluidic communication between the set of inlet ducts with an expansion chamber and a thermal communication with a heating tower;
- to establish a fluidic communication between the expansion chamber and the set of outlet ducts;
- to establish a fluidic communication between the set of outlet ducts and the set of inlet ducts;
- to promote by suction the entrance of gases into the set of inlet ducts;
- to establish flows of gases alternately between inlet ducts and outlet ducts and vice-versa, in such a way to expand the gases dynamically;
- to expand the gases thermally to each flow between the inlet ducts and the outlet ducts; and
- to expose the gases magnetically to magnetic fields to each flow between the inlet ducts and the outlet ducts and vice-versa.

BRIEF DESCRIPTION OF THE FIGURES

The present invention will be described in more detail, as follows, based on the examples represented in the drawings.

The figures indicate.

DETAILED DESCRIPTION OF VARIOUS EMBODIMENTS

Figure 1:
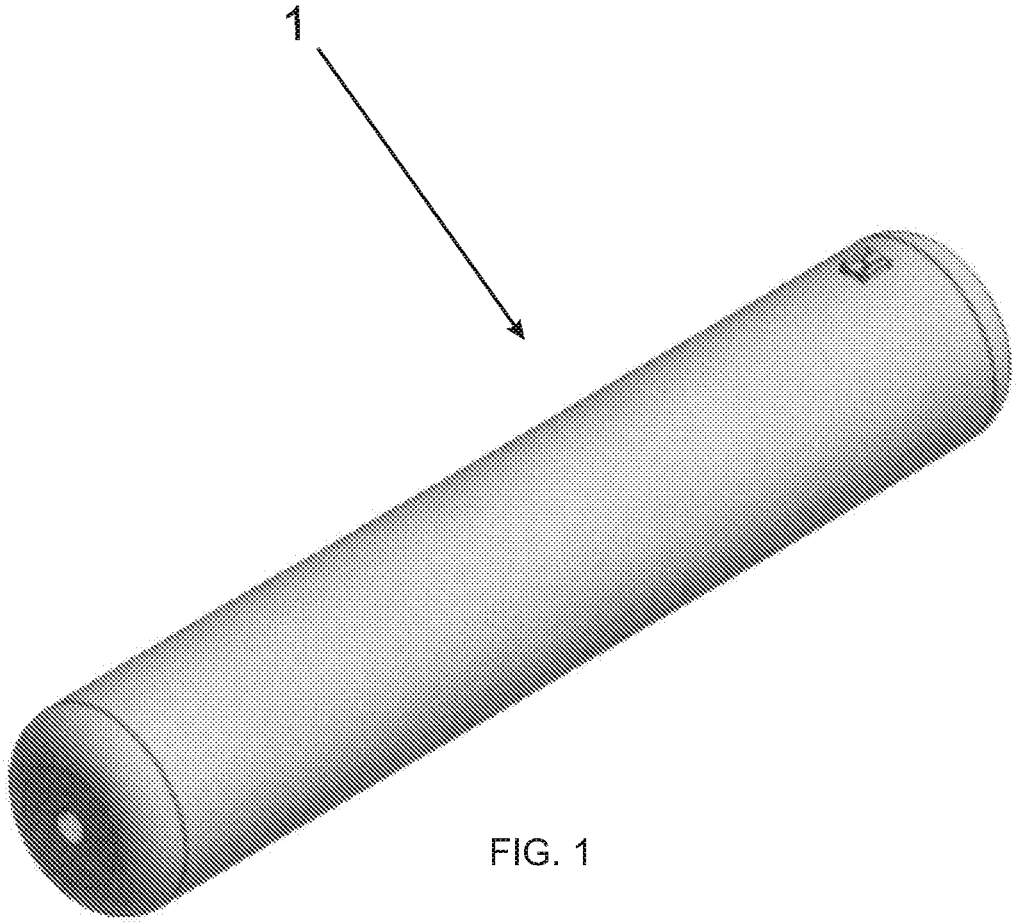
FIG. 1—is a view of the device to optimize the efficiency of the combustion of gases for the production of clean energy that is the object of the present invention when assembled.

With the intention of overcome the problems pointed out in the state of the art, a device to optimize the efficiency of the combustion of gases for the production of clean energy 1 was developed. The device 1 can be used in a system to optimize the efficiency of the combustion of gases and by means of a method to optimize the efficiency of the combustion of gases as described later.

The device to optimize the efficiency of the combustion of gases for the production of clean energy 1 that is the object of the present invention was developed to optimize gases 201 based on hydrogen, in such a way to promote the reduction of the radius of the orbit of the electrons of the hydrogen atoms around the nucleus to quantum numbers ≤1 in order to produce hydrogen atoms in lower than ground level energy states and correspondingly increase the kinetic energy of the nuclei of the gas molecules and maintain this optimizing effect until its consumption.

Preferentially, the gases 201 contain a mixture of oxyhydrogen and previously ionized air. Evidently, this only involves a preferential configuration, in such a way that the gases 201 can only contain a mixture of oxyhydrogen.

The device 1 can be perfectly coupled to any type of conventional internal combustion engine using gasoline, natural gas, LPG, Biogas or any others gases from the light hydrocarbon chains (Otto cycle) or diesel and biodiesel (Diesel cycle), marine engines, turbines, generators, to power a boiler burner or industrial coal furnace, fuel oil and fuel cells, among others. The above specified engines are henceforth generically called a mechanical energy generating device 300, but this is not limited to only the previously used examples.

As highlighted previously, the device to optimize the efficiency of the combustion of gases for the production of clean energy 1 differs from any other that already exists, whether by its physical and/or functional characteristics, highlighted by its efficiency with respect to the accumulation of gases 201, 202 in tanks or any other types of unnecessary containers. Its main characteristic is to replace fossil fuels, avoiding the harm caused by their use and providing more favorable conditions for the common good.

As can be observed from FIGS. 1 to 10, the device to optimize the efficiency of the combustion of gases for the production of clean energy 1, when assembled/sealed, has a substantially cylindrical format, which is used to receive gases 201 from an external source 200 and to optimize them for subsequent use by the mechanical energy generating device 300, as will be subsequently described.

Taking into account that, preferentially, the gases 201 contain a mixture of oxyhydrogen and ionized air, it can be observed that the external source 200 is configured to produce, through the electrolysis of the water 100, oxyhydrogen. In this case, the external source 200 is an electrolytic cell. For the production of ionized air, a second external source 200 or a cylinder can be used.

Obviously the use of an electrolytic cell is only a preferential configuration, in such a way that any other fuel cell capable of generating a gas based on hydrogen can be used.

Alternatively, it is possible to replace the electrolytic cell by a container with pressurized hydrogen or any other hydrogen based gas, the container, for example, being connected fluidly to the decompression chamber/flask with a flow control valve, allowing the device to optimize gases for the production of clean energy 1 to receive these gases, optimize them and produce clean energy in accordance with the teachings of the present invention.

Another alternative configuration allows the oxidizing element to be independently injected into the mechanical energy generating device 300 for subsequent mixture with the optimized gases (by the reduction of the energy state of the hydrogen atoms and corresponding increase of the kinetic energy of the nucleus of their molecules) 202 by the device 1 that is the object of the present invention.

Alternatively, the device to optimize gases for the production of clean energy 1 can be used in a mechanical energy generating device 300 jointly with other fuels, such as gasoline, natural gas, LPG, biogas or any others gases from the light hydrocarbon chains (Otto cycle) or diesel and biodiesel (Diesel cycle). In this hybrid configuration, the device 1 acts as a fuel saver because less injection of fuel (gasoline or diesel) is necessary, maintaining the high power in the mechanical energy generating device 300.

Figure 10:
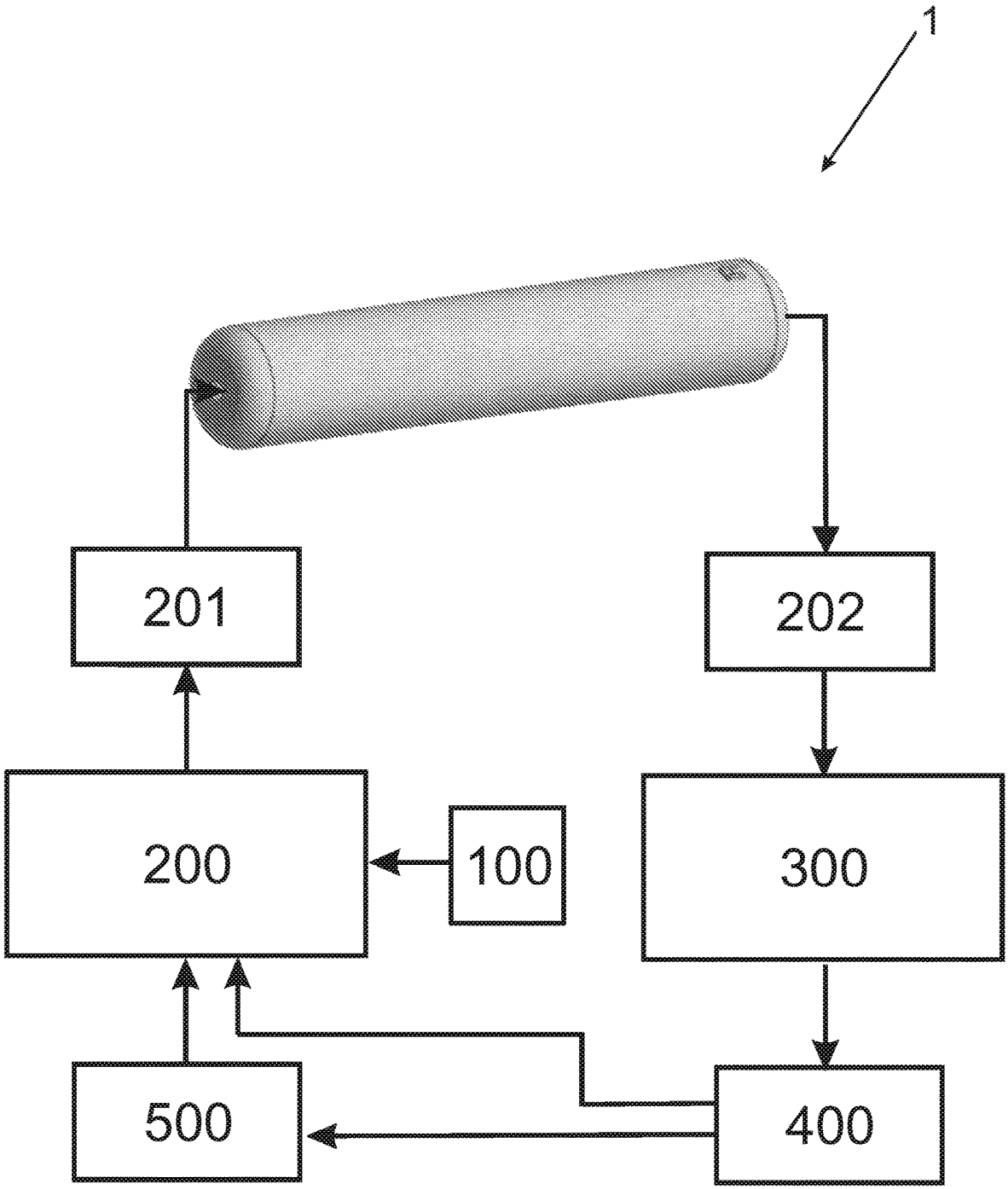
FIG. 10—is the schematic visualization of the system that is the object of the present invention, evidencing the connection of the device to optimize the efficiency of the combustion of gases for the production of clean energy to the external source and to the mechanical energy generating device in accordance with the teachings of the present invention.

Still in reference to FIG. 10, it can be noted that the device to optimize gases for the production of clean energy 1 receives gases 201 from an external source 200, and promotes their optimization by the reduction of the energy state of the hydrogen atoms and corresponding increase of the kinetic energy of the nucleus of their molecules, in such a way to generate the gases 202.

It is important to note that the external source 200 can be connected to a water tank 100, if the source 200 is an electrolytic cell. It is also noted that the external source 200 is connected electrically to a power source 500, which can be intermittently used, if necessary. To initiate the process of electrolysis, the power source 500 supplies the initial current to the external source 200 and, subsequently, is disconnected from the external source 200. In order to maintain the process of electrolysis of the external source 200 in operation, a current generating device 400, connected to the mechanical energy generating device 300, is directly connected to the external source 200. The current generating device 400, alternatively, can repower the power source 500.

It can be observed that, in this way, the generation process of oxyhydrogen present in the gases 201 from the external source 200 is continually realized and, consequently, the generation of optimized gases by the reduction of the energy state of the hydrogen atoms and corresponding increase of the kinetic energy of the nucleus of their molecules 202 used by the mechanical energy generating device 300. It is noted that the energy balance and energy transformation are continually realized within the system that uses the device to optimize gases for the production of clean energy 1.

As highlighted previously, the optimization of the gases 201 occurs through the continued and repetitive exposure of the molecules of these gases 201 to magnetic fields of variable intensity, orientation, direction and polarity, combining this exposure with processes of acceleration of movement of the hydrogen atoms and ions of oxygen and argons contained in the ionized air, volumetric expansion and gain of temperature and repeating this cycle of conditioning for a sufficient number of times, in order that the magnitude of the gains of energetic efficiency are maximized and the obtained gain is maintained stable for a sufficient time until the gas fuel has been used in a subsequent redox process.

It is important to highlight that this process is only possible due to the unique, new and inventive characteristics of the device 1 that is the object of the present invention, as will be described in more detail later.

Having described the basic operation of the system that is the object of the present invention, next it will be described in detail the structural and functional characteristics of the device to optimize gases for the production of clean energy 1 that optimize the gases 201 by means of the reduction of the energy state of the hydrogen atoms and corresponding increase of the kinetic energy of the nucleus of their molecules with ions of oxygen and argon present in the ionized air.

Figure 2:
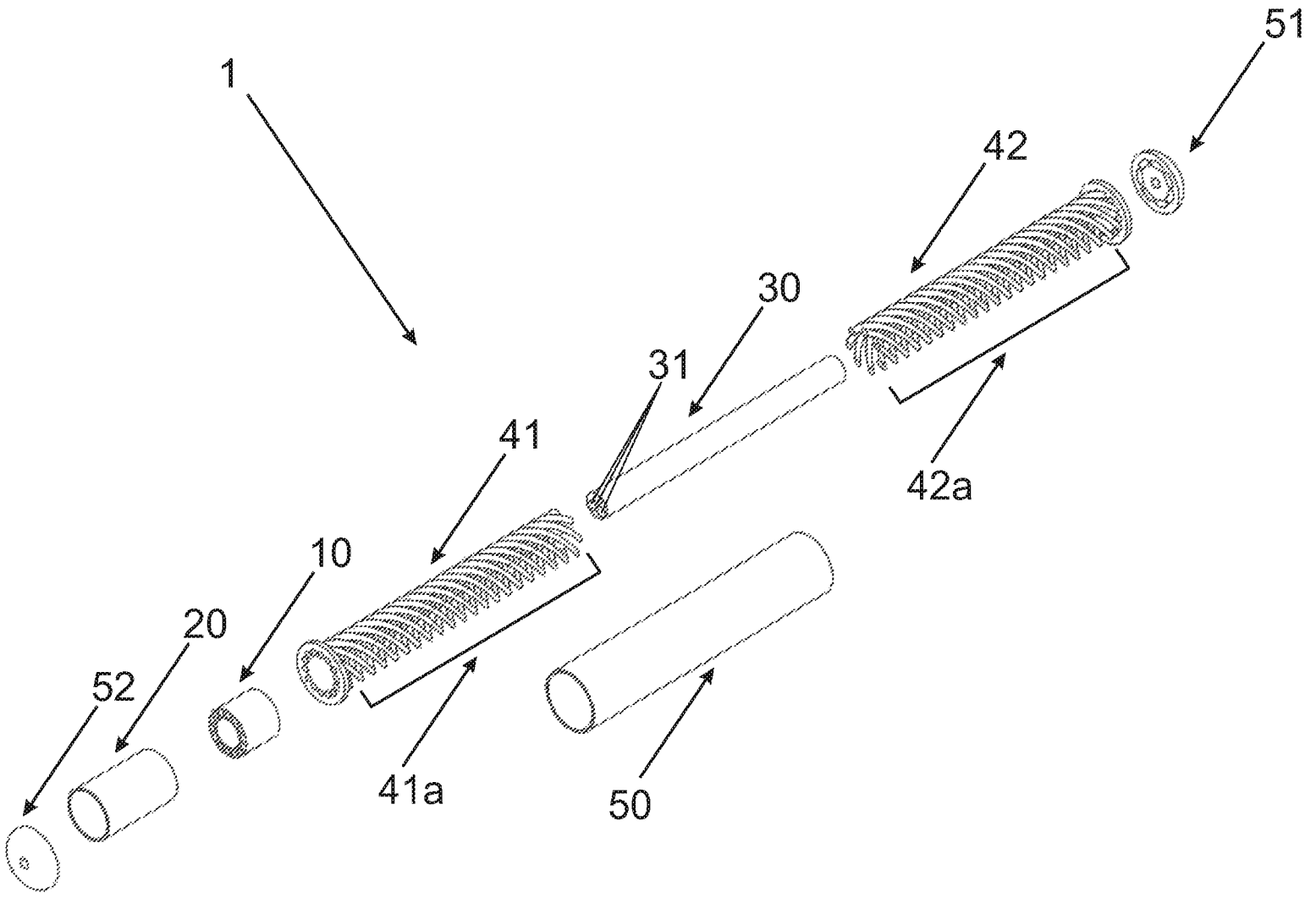
FIGS. 2 and 3—are exploded views of the device to optimize the efficiency of the combustion of gases for the production of clean energy that is the object of the present invention, illustrating in detail each element of its composition.
Figure 3:
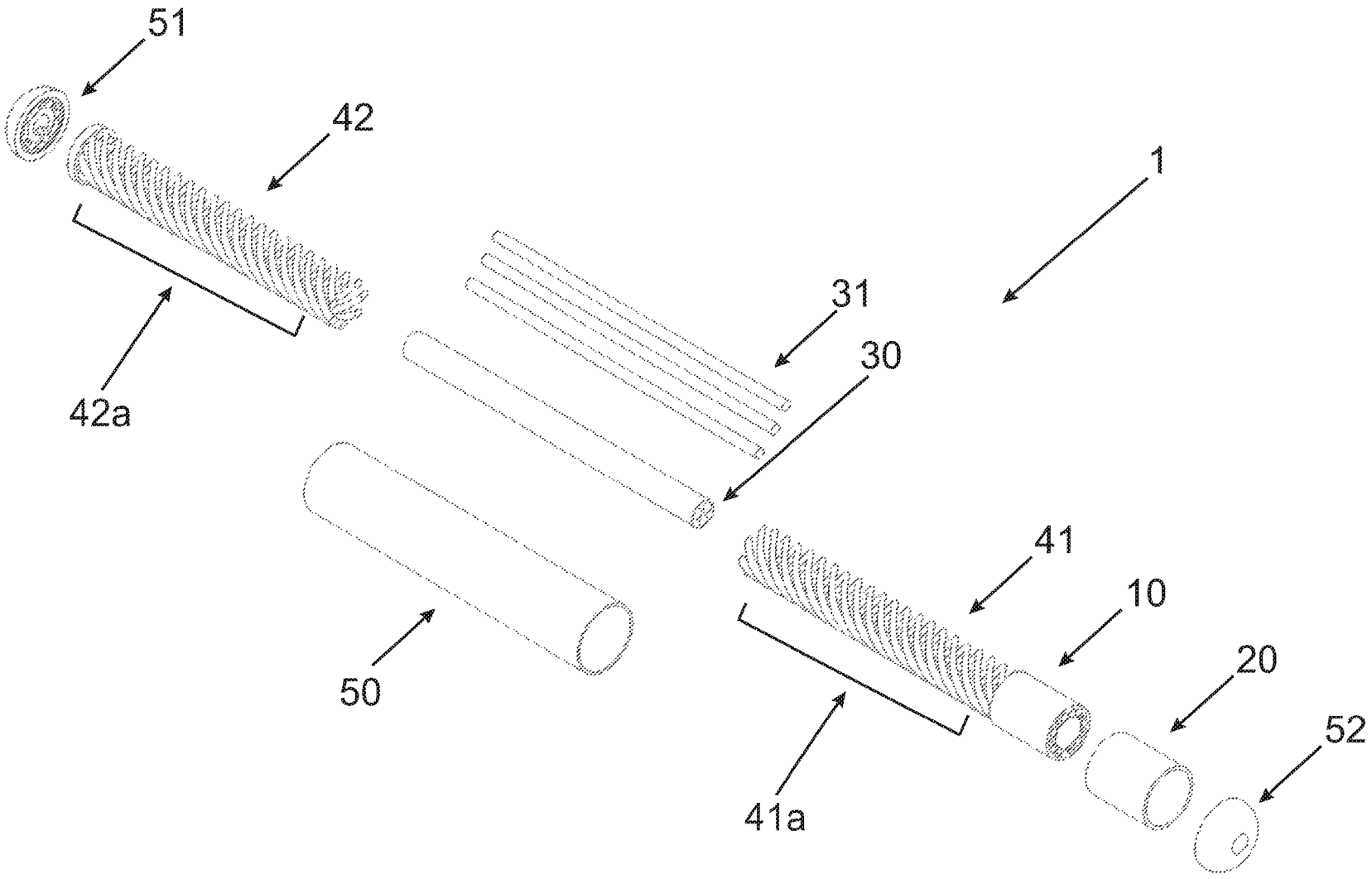

The exploded views of the device to optimize gases for the production of clean energy 1 can be observed from FIGS. 2 and 3, illustrating the elements of its composition. It can be observed that the device 1 it comprises an expansion chamber 10, a heating tower 20, a magnetic nucleus 30 provided with bars 31, a set of inlet ducts 41, a set of outlet ducts 42, an external casing 50, a distribution chamber of inlet gases 51 and a distribution chamber of outlet gases 52.

In a preferential configuration, the magnetic nucleus 30, the sets of inlet and outlet ducts 41, 42 and the distribution chambers of inlet and outlet gases 51, 52 are made from stainless steel AISI 316 or 316L, ceramic, engineering polymers such as nylon, ABS, polyester, or other non-magnetic metal alloys.

Figure 4A:
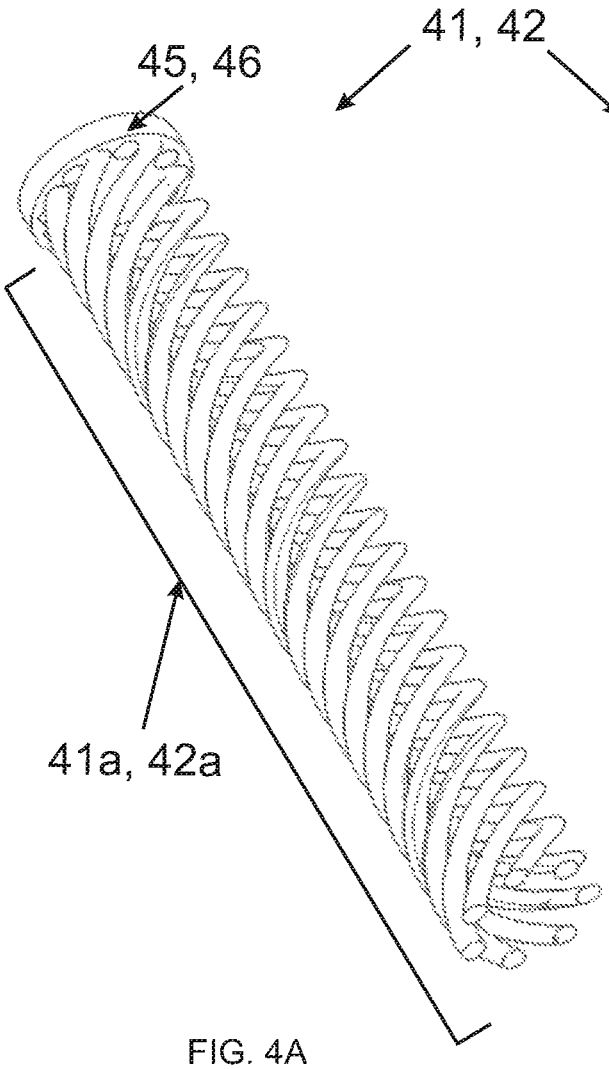
FIGS. 4A to 4D—are views in upper perspective in detail and frontal of the sets of inlet and outlet ducts that compose the device to optimize the efficiency of the combustion of gases for the production of clean energy that is the object of the present invention.
Figure 4B:
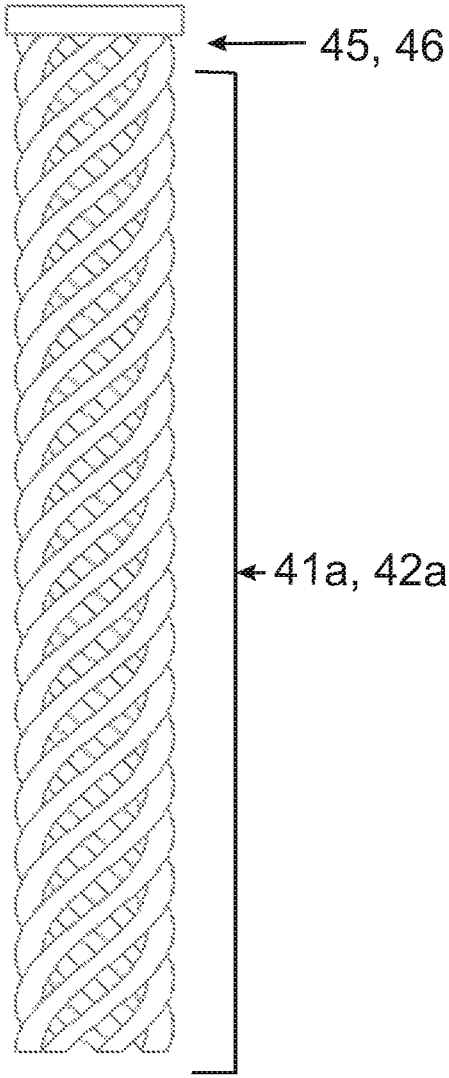
Figure 4C:
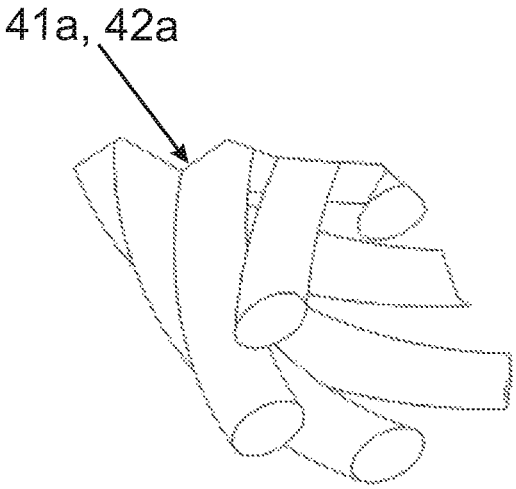
Figure 4D:
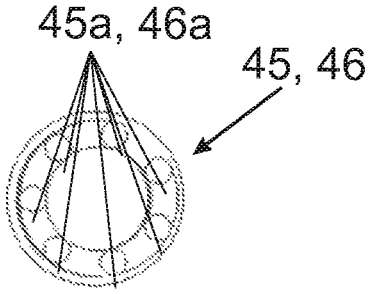

As can be observed from FIGS. 4A and 4B, the sets of inlet ducts 41, 42 have, respectively, a plurality of inlet and outlet ducts 41*a*, 42*a*. Preferentially, the device 1 has at least 7 inlet ducts 41*a* and at least 6 outlet ducts 42*a*, allowing a process of polarization and reorganization to occur at least 6 times.

It should be noted that the higher the number of ducts 41*a*, 42*a*, the higher is the optimization of the efficiency of the combustion of gases for the production of clean energy. In other words, by increasing the number of ducts 41*a*, 42*a*, the alternation of flows between the inlet and outlet ducts 41*a*, 42*a* and the exposure to magnetic fields 35 will be increased as well. Consequently, the number of dynamic and thermal expansions and the magnetic exposure of the gases 201 will be increased, such expansions and exposure increasing the optimization of the efficiency of the combustion of gases for the production of clean energy.

In a preferential configuration, the ducts 41*a*, 42*a* have substantially helical geometries and are symmetric with each other, they projecting from the respective inlet and outlet flanges 45, 46 and having a length proportional to the magnetic nucleus 30, as will be better explained later.

The ducts 41*a*, 42*a* have a diameter of approximately 9 mm (millimeters) and a linear length measured from the flanges 45, 46 to the end of the ducts 41*a*, 42*a*, each one of the ducts 41*a*, 42*a* having three revolutions of 360 degrees with steps of approximately 120 mm (millimeters), having a length of approximately 360 mm (millimeters). Evidently this only involves a preferential configuration, in such a way that, alternatively, different revolutions and steps can be adopted, as long as they take into account the length of the ducts 41*a*, 42*a*.

It should be noted that the higher is the length of the ducts 41*a*, 42*a*, the higher and the longer is the exposure to magnetic fields 35, such exposure increasing the optimization of the efficiency of the combustion of gases for the production of clean energy.

Preferably, if the user of the device 1 object of the present invention wishes to increase the optimization of the efficiency of the combustion of gases for the production of clean energy, one shall consider to increase the number of ducts 41*a*, 42*a*, the number of clusters of each bar 31 and to increase the length of the ducts 41*a*, 42*a*, such that the processes of dynamic and thermally expansions and magnetic exposure will be proportionally increased, resulting in a proportionally increased optimization of the efficiency of the combustion of gases for the production of clean energy.

It can be observed that this only involves a preferential configuration, in such a way that these measurements are not of a limiting character. Depending on the type of mechanical energy generating device 300 or the external source 200, the dimensions of the above elements can be proportionally re-sized.

As will be detailed later, the length should be less than the length of the external casing 50 that incorporates the elements that assemble the device to optimize gases for the production of clean energy 1.

The external casing 50 can be made from stainless steel AISI 316 or 316L, ceramic, engineering polymers such as nylon, ABS, polyester, or other non-magnetic metallic alloys.

It is important to highlight that the helical geometry adopted preferentially allows that a maximum number of magnetic fields 35 of variable intensity, orientation, direction and polarity to interact perpendicularly to the movement of the atoms of the gases 201 within the ducts 41*a*, 42*a*. The large interaction between the magnetic fields 35 and the atoms of the gases 201 allows the acceleration of the hydrogen atoms and ions of oxygen and argons contained in the ionized air in the gases 201, in particular, from the oxyhydrogen gases and ionized air, as will be described later.

Alternatively, the ducts 41*a*, 42*a* can adopt other types of geometries (for example, cylindrical or rectangular), as long as these allow the magnetic fields 35 to interact perpendicularly to the movement of the atoms of the gases 201 within the ducts 41*a*, 42*a*.

Another alternative would be to adopt annular tubular geometries with straight ducts 41*a*, 42*a* and a magnetic nucleus 30 with rotation in its longitudinal axis, in such a way to produce the same effect of relative movement of the molecules of gas in ducts 41*a*, 42*a* with a helical format.

Still in a preferential configuration, it can be observed that the flanges 45, 46 have an external diameter of approximately 60 mm (millimeters) and a substantially circular format and have a plurality of peripherally positioned grooves 45*a*, 46*a*. It can be noted from FIGS. 4A to 4D that the diameter of the peripherally positioned grooves 45*a*, 46*a* is equal to the diameter of the inlet and outlet ducts 41*a*, 42*a*, in such a way that both the elements can be appropriately connected, as will be described later.

In the case of the set of inlet ducts 41, the inlet ducts 41*a* are connected, in an alternately way, with the respective grooves of the plurality of peripherally positioned grooves 45*a*. More specifically, each inlet duct 41*a* is connected to a groove 45*a*, the groove 45*a* adjacent to this remaining free until the complete assembly of the device 1, as will be subsequently described.

Similarly, in the case of the set of outlet ducts 42, the outlet ducts 42*a* are connected, in an alternately way, with the respective grooves of the plurality of peripherally positioned grooves 46*a*. More specifically, each outlet duct 42*a* is connected to a groove 46*a*, the groove 46*a* adjacent to this remaining free until the complete assembly of the device 1, as will be subsequently described.

Once the sets of inlet and outlet ducts 41, 42 are formed, taking into account that these have a plurality of inlet and outlet ducts 41*a*, 42*a* with substantially helical formats, it can be observed that the sets 41, 42 form a substantially circular region, where the magnetic nucleus 30 is subsequently assembled concentrically and adjacently, as will be subsequently described.

Figure 5A:
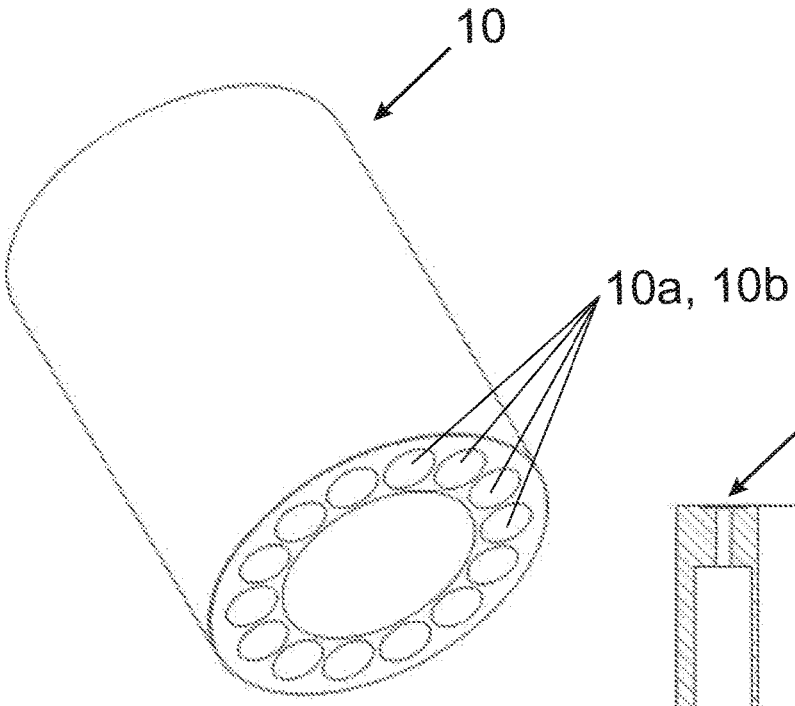
FIGS. 5A to 5C—are views in perspective, sectional and frontal of the expansion chamber that composes the device to optimize the efficiency of the combustion of gases for the production of clean energy that is the object of the present invention.
Figure 5B:
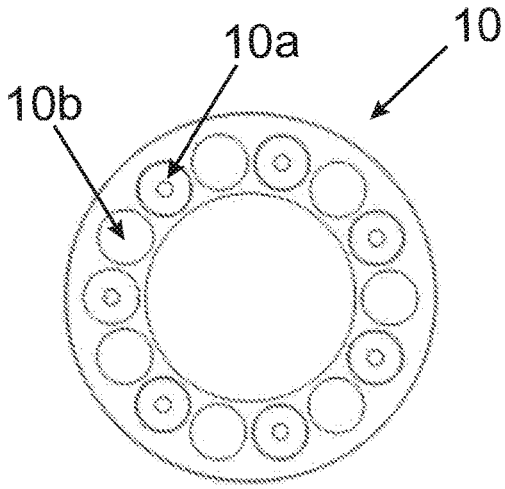
Figure 5C:
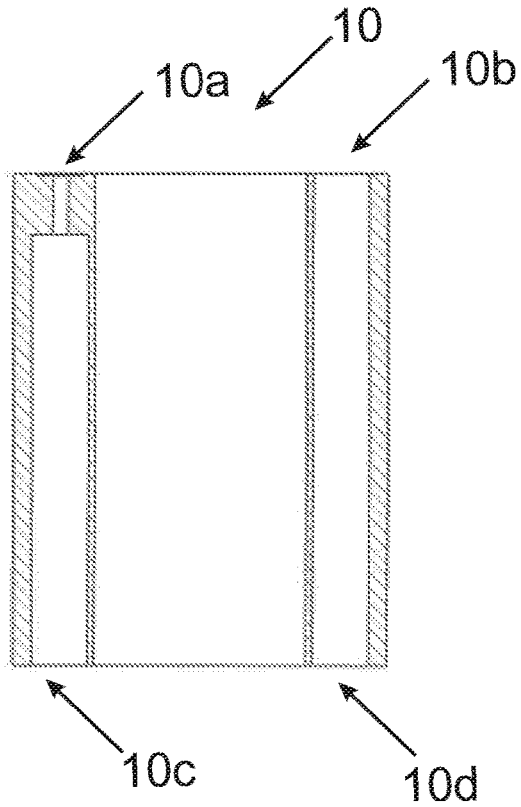
Figure 6A:
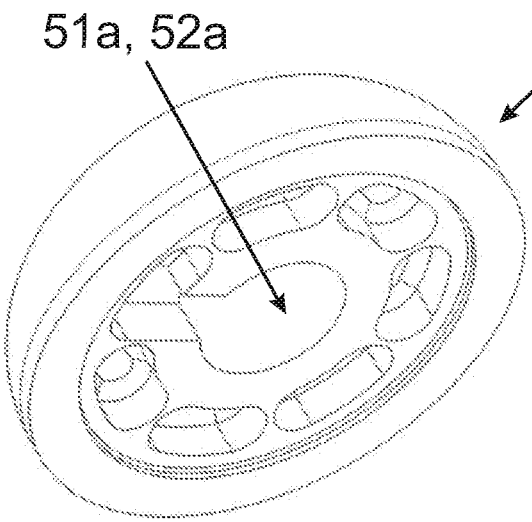
FIGS. 6A to 6E—are views in perspective, sectional, lateral and frontal interior of the distribution chambers of inlet and outlet gases that compose the device to optimize the efficiency of the combustion of gases for the production of clean energy that is the object of the present invention.
Figure 6D:
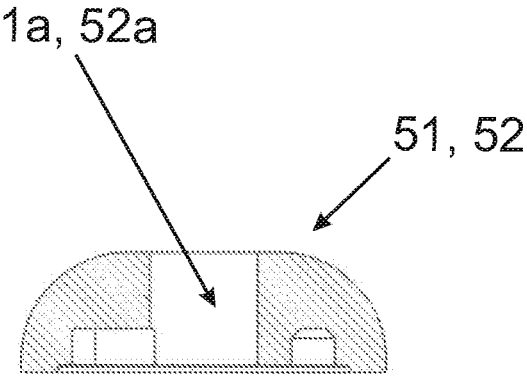
Figure 6B:
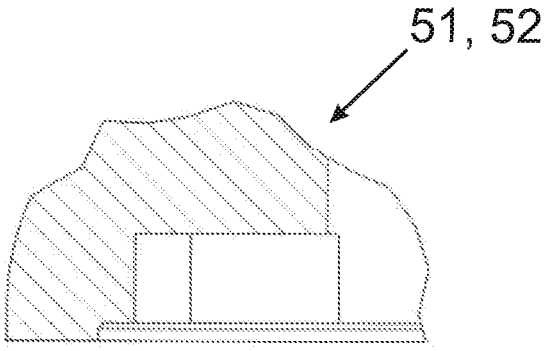
Figure 6C:
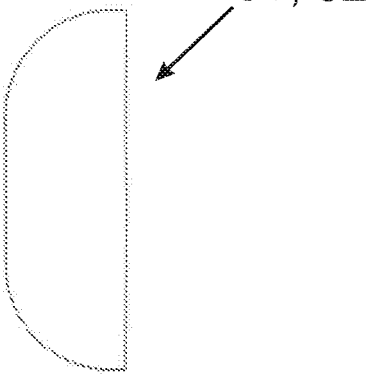
Figure 6E:
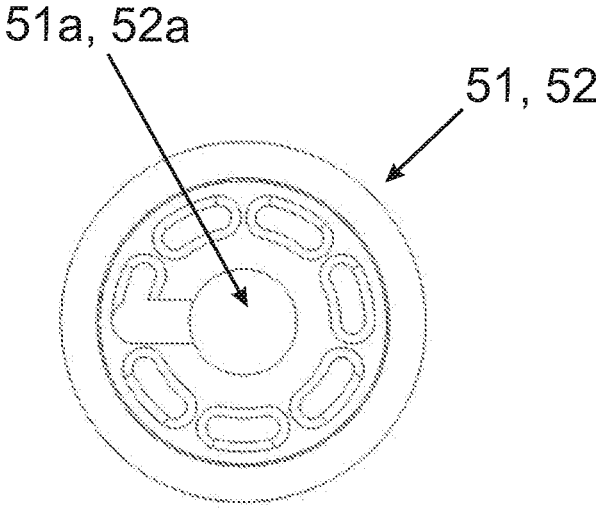

As can be observed from FIGS. 5A to 5C, the expansion chamber 10 has a substantially cylindrical format and, similarly to the flanges 45, 46, also has an external diameter of approximately 60 mm (millimeters) and a plurality of peripherally positioned grooves 10*a*, 10*b*, 10*c*, 10*d*. The grooves 10*a*, 10*b* are peripherally positioned in one of the ends of the chamber 10 and the grooves 10*c*, 10*d* in the opposite end of the chamber 10.

Preferentially, the grooves 10*b*, 10*c*, 10*d* have a diameter of approximately 9 mm (millimeters). On the other hand, the groove 10*a* initially has a diameter of 9 mm (millimeters), narrowing to a diameter of 2.5 mm (millimeters) until it enters into contact with a cavity of the chamber that has a diameter of 9 mm (millimeters). The narrowing and subsequent expansion of diameter allows the gases 201 to accelerate and expand internally in the cavity until they arrive at the groove 10*c*. The number of grooves 10*a*, 10*b*, 10*c*, 10*d* are proportional to the number of inlet and outlet ducts 41*a*, 42*a* connected to the flanges 45, 46.

As will be detailed later, the expansion chamber 10 is connected fluidly to the inlet flange 45*a* and, for this reason, should have compatible dimensions with each other. In this context, it can be observed that the external diameter of the expansion chamber 10 will be approximately 60 mm (millimeters) and the length approximately 80 mm (millimeters).

It can be observed that this only concerns a preferential configuration, in such a way that these measurements are not of a limiting character. Depending on the type of mechanical energy generating device 300 or the external source 200, the dimensions of the above elements can be proportionally re-sized.

In relation to the FIGS. 2 and 3, it can be observed that the heating tower 20 is, in a preferential configuration, connected concentrically to the external surface of the expansion chamber 10. The heating tower 20 has similar dimensions to those observed in the expansion chamber 10.

Still preferentially, it is noted that the heating tower 20 is an annular electric resistance with approximately 100 W (Watts) of power assembled around the expansion chamber 10. The heating tower 20, in a preferential configuration, is configured to force the heat exchange of the gases 201, 202, with its heating by convection until it reaches the range between 55 and 65° C. (degrees Celsius).

Alternatively, the heating tower 20 exchanges heat with the expansion chamber 10 by means of thermal transfer by induction, vapor, bridge of transistors and conduction through a dissipater or any means capable of heating its surface, transmitting thermal energy to the chamber 10 and consequently to the interior of the chamber 10.

As can be observed from FIGS. 6A to 6E, the distribution chambers of the inlet and outlet gases 51, 52 have a substantially concave face and, therefore, semicircular, while the opposite face is substantially flat and has a plurality of cavities to house the connections between the ducts 41*a*, 42*a*, as will be subsequently described. The number of cavities is proportional to the number of inlet and outlet ducts 41*a*, 42*a* connected to the flanges 45, 46.

In a preferential configuration, the flat face of the distribution chambers of inlet and outlet gases 51, 52 has a diameter of approximately 75 mm (millimeters) and a width of approximately 25 mm (millimeters). The diameter is sufficient to connect correctly the distribution chamber of inlet gases 51 to the outlet flange 46 and to connect correctly the expansion chamber 10 to the distribution chamber of outlet gases 52.

The distribution chambers of the inlet and outlet gases 51, 52 still are provided with an input 51*a* and an output 52*a*. The input 51*a* and the output 52*a* are respectively connected fluidly to an external source 200 and to the mechanical energy generating device 300, as will be described later. In a preferential configuration, the input and the output 51*a*, 52*a* have a diameter of approximately 22 mm (millimeters). It can be observed that this only concerns a preferential configuration, in such a way that these measurements are not of a limiting character. Depending on the type of mechanical energy generating device 300 or the external source 200, the dimensions of the above elements can be proportionally re-sized.

Figure 7B:
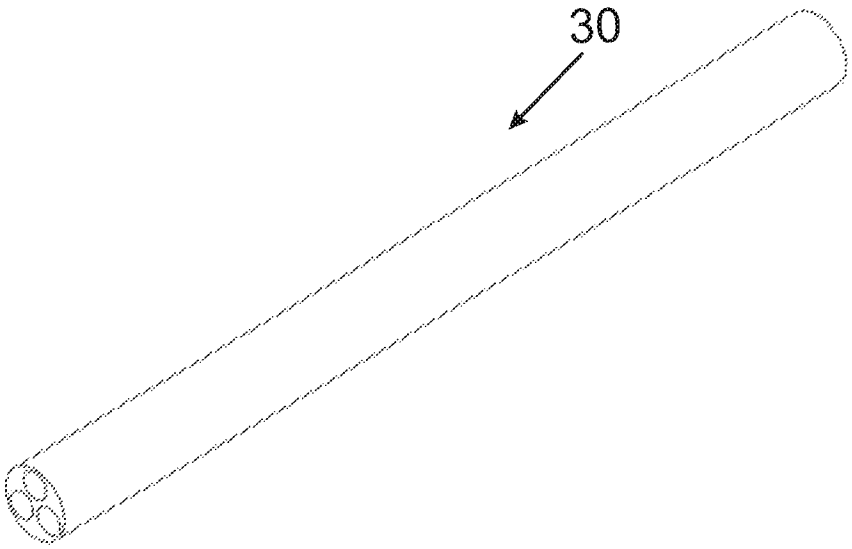
FIGS. 7A and 7B—are views in perspective and frontal of the magnetic nucleus that composes the device to optimize of the efficiency of the combustion of gases for the production of clean energy that is the object of the present invention.
Figure 7A:
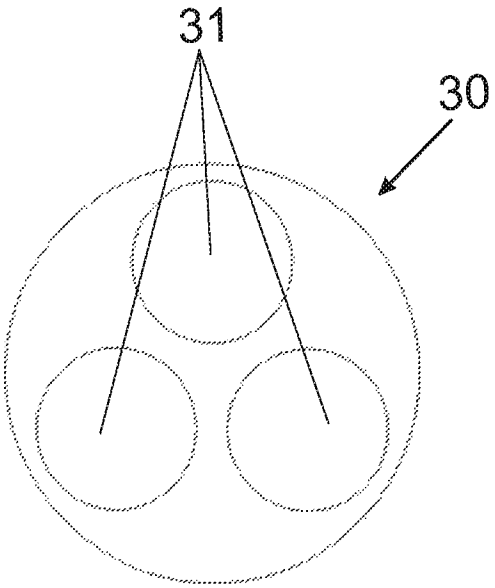

As can be observed from FIGS. 7A and 7B, the magnetic nucleus 30 has a substantially cylindrical format and a length proportionally equal to the linear length of the ducts 41*a*, 42*a*. In a preferential configuration, the magnetic nucleus 30 has a diameter of approximately 32 mm (millimeters), the dimension is proportional to the substantially circular region formed by the sets of inlet and outlet ducts 41, 42, in such a way that inlet and outlet ducts 41*a*, 42*a* extend helically and adjacently around the external surface of the magnetic nucleus 30. Furthermore, as previously described, the magnetic nucleus 30 is arranged concentrically to the sets 41, 42, as illustrated in the exploded views of FIGS. 2 and 3.

As highlighted previously, alternatively, is possible to adopt annular tubular geometries with straight ducts 41*a*, 42*a* and a magnetic nucleus 30 with rotation in its longitudinal axis, in such a way to produce the same effect of relative movement of the molecules of gas in ducts 41*a*, 42*a* with a helical format.

Still in a preferential configuration, it can be observed from FIGS. 7A and 7B that the magnetic nucleus 30 has at least one substantially circular cavity that extends along the entire length of the nucleus 30. The magnetic nucleus 30 is provided with three cavities positioned alternately with each other, forming an angle of approximately 120° (degrees) between their centers. The cavities have a diameter of approximately 20 mm (millimeters), sufficient to receive individually each of the magnetic bars 31.

When in operation, each of the bars 31 is configured to generate magnetic fields 35 of variable intensity, orientation, direction and polarity, in such a way that these interact perpendicularly to the movement of the atoms of the gases 201 within the ducts 41*a*, 42*a*. The large interaction between the magnetic fields 35 and the atoms of the gases 201 allows the acceleration of the hydrogen atoms and ions of oxygen and argons contained in the ionized air of the gases 201, in particular, from the oxyhydrogen gases and ionized airs, as will be described later.

Figure 9:
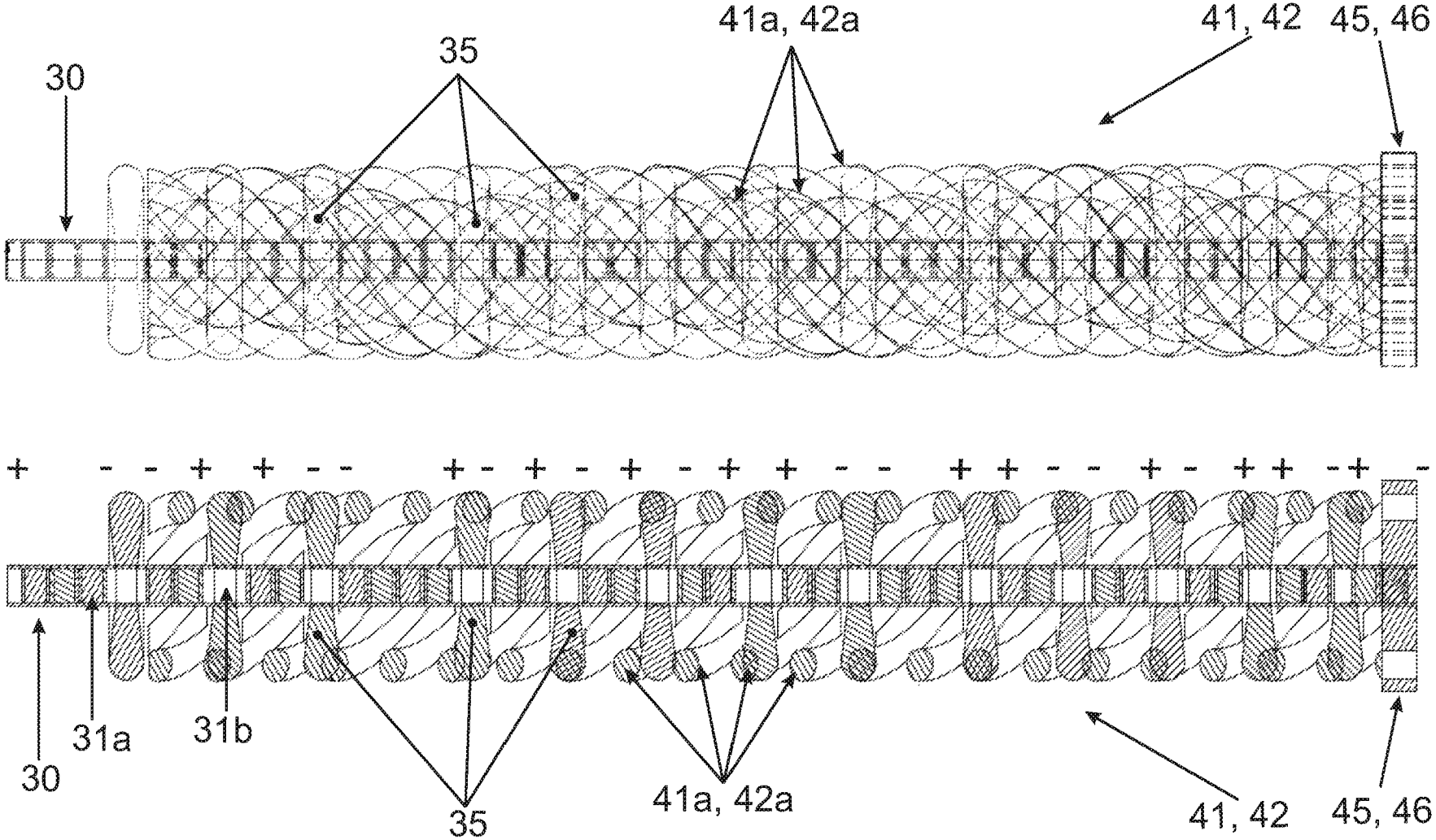
FIG. 9—are visualizations of the interaction between the plurality of inlet and outlet ducts with a maximum number of magnetic fields of variable intensity, orientation, direction and polarity generated by the bar of the magnetic nucleus, for the magnetic and molecular reorganization and polarization of gases.

This incidence and interaction are illustrated in FIG. 9, which indicates the ducts 41*a*, 42*a* penetrating as far as possible the magnetic fields 35 of intensity, orientation, direction and polarity. This allows the formation of a coherent beam of flow of gases 201, in particular oxyhydrogen and ionized air, which allows the acceleration of the hydrogen atoms and ions of oxygen and argons contained in the ionized air of the gases 201. This beam is formed so that the flow of gases 201 is optimized, consequently making the mixture of gases 202 more efficient for combustion (redox) compared to the techniques known in the state of the art.

Preferentially, the magnetic nucleus 30 is made from non-magnetic materials (from stainless steel AISI 316 or 316L), while the bars 31 are made of magnets from rare earth metals (such as the alloy of neodymium-iron-boron Nd—Fe—B or samarium-cobalt Sm—Co).

Alternatively, the bars 31 can be made from ferrite, electromagnets, such as non-permanent magnets, electromagnetic means, a circuit of electromagnets energized by a power circuit and managed by the electronic circuit or any other means known in the state of the art capable of generating a magnetic field.

Figure 8:
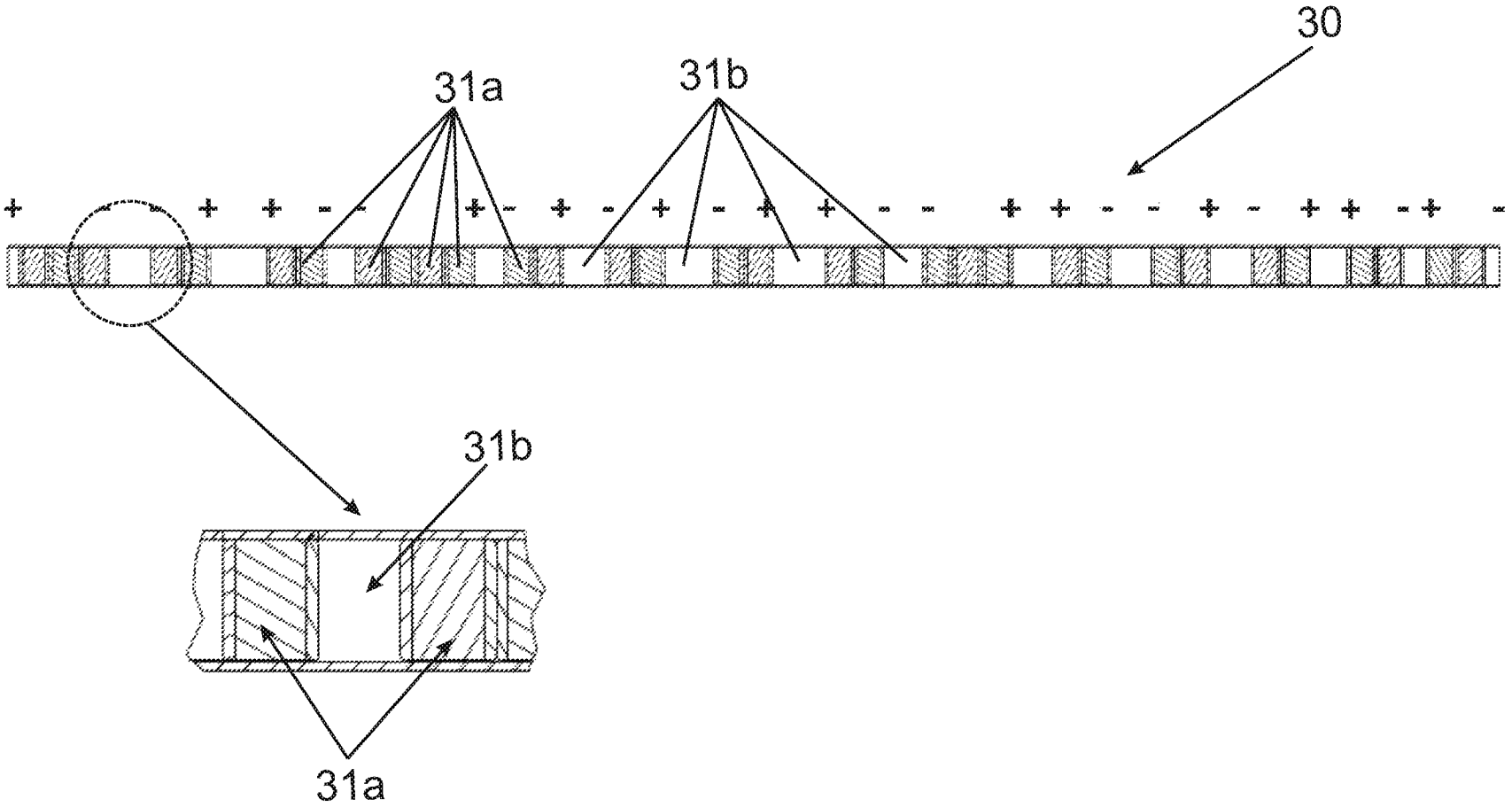
FIG. 8—is a view of the interior of the bars that compose the magnetic nucleus illustrated in the FIGS. 7A and 7B, elements of the device to optimize the efficiency of the combustion of gases for the production of clean energy that is the object of the present invention.

As indicated in detail from FIGS. 8 and 9, the three bars 31 of the magnetic nucleus 30 have a plurality of magnetic elements 31*a* and gaps 31*b*. The magnetic elements 31*a* are preferentially made of magnets from rare earth metals (such as the alloy of neodymium-iron-boron Nd—Fe—B or samarium-cobalt Sm—Co) or any type of material capable of generating magnetic fields of variable intensity, orientation, direction and polarity. In a preferential configuration, the magnetic elements 31*a* have a diameter of approximately 20 mm (millimeters) and a width of 16 mm (millimeters).

Still preferentially, the magnetic elements 31*a* are positioned, in an alternately way, with the gaps 31*b*, for example, adopting the polarization sequence of the type +−/−+/+−/−+/−+/−+/−+/+−/−+/+−/−+/−+/+−/+−. It can be observed that this only concerns a preferential configuration, in such a way that other polarization sequences can be used as long as the characteristics of a minimum number of clusters and a minimum number of polarity inversions are maintained, and that the described sequence is not of a limiting character.

Such a sequence is used in tests to indicate the intensification of interaction of the gases 201 in the interior of the ducts 41*a*, 42*a* with a maximum number of magnetic fields 35 of variable intensity, orientation, direction and polarity. Preferentially, each bar 31 has at least 14 clusters with 32 magnetic elements 31*a*, with these positioned linearly and having at least 8 polarity inversions from the clusters in each bar 31.

It should be noted that the higher is the number of clusters of each bar 31, the higher is the optimization of the efficiency of the combustion of gases for the production of clean energy. In other words, by increasing the number of clusters of each bar 31, the gases 201 will be exposed to an increased number of magnetic fields 35 when flowing between the ducts 41*a*, 42*a*, which result in an increase of the optimization of the efficiency of the combustion of gases for the production of clean energy.

Preferably, if the user of the device 1 object of the present invention wishes to increase the optimization of the efficiency of the combustion of gases for the production of clean energy, one shall consider to increase the number of ducts 41*a*, 42*a*, the number of clusters of each bar 31 and to increase the length of the ducts 41*a*, 42*a*, such that the processes of dynamic and thermally expansions and magnetic exposure will be proportionally increased, resulting in a proportionally increased optimization of the efficiency of the combustion of gases for the production of clean energy.

The tests indicate that the magnetic nucleus 30 is capable of generating a magnetic field 35 with the intensity of 9.5 MG/950 Teslas (equal to the intensity of the magnets used of neodymium-iron-boron Nd—Fe—B) in its interior and in its most external part reaching 15 MG/1.500 Teslas in the external surface of the magnetic nucleus 30.

The above cited configuration provides a high interaction between the ducts 41*a*, 42*a* and a maximum number of magnetic fields 35 of variable intensity, orientation, direction and polarity generated by the magnetic nucleus 30, allowing high efficiency in the formation of the coherent beam of flow of gases 201, in particular oxyhydrogen mixed with ionized air, and high efficiency in the acceleration of the hydrogen atoms and ions of oxygen and argons contained in the ionized air of the gases 201, as will be better explained later.

It can be observed that this only concerns a preferential configuration, in such a way that the number of cavities and bars 31 can vary depending on the dimensions of the device 1. Furthermore, the abovementioned measurements are not of a limiting character. Depending on the type of mechanical energy generating device 300 or the external source 200, the dimensions of the above elements can be proportionally re-sized.

It can be observed that the elements that compose the above described device 1 can be made through different methods of construction and from different types of materials. Furthermore, the abovementioned elements that compose the device 1 can be connected modularly, by means of the connection of the elements individually or by means of the connection of blocks formed by the elements of the device 1.

How all the above described elements are connected will now be described, in such a way to assemble the device to optimize gases for the production of clean energy 1.

The assembly of the device 1 begins with the insertion of the magnetic bars 31 into the cavities of the magnetic nucleus 30. It is important to note that the bars 31 remain hermetically sealed when in the interior of the cavities, in such a way that no foreign bodies can enter.

After the abovementioned connection, the sets of inlet and outlet ducts of gases 41, 42 are arranged concentrically to the magnetic nucleus 30, in such a way that a plurality of inlet and outlet ducts 41*a*, 42*a* extend helically and adjacently around the external surface of the magnetic nucleus 30.

It can be observed that the pluralities of peripherally positioned grooves 45*a*, 46*a* of the sets of inlet and outlet ducts 41, 42, which remain free (as described previously), receive, respectively, the outlet ducts 42*a* and the inlet ducts 41*a*. In this way, it can be observed that the sets of inlet and outlet ducts 41, 42 are connected operatively with each other, so that the inlet and outlet flanges 45, 46 fix both the inlet ducts 41 and the outlet ducts 42.

After the above stage, the inlet flange 45 is connected fluidly and mechanically to the expansion chamber 10, this connection performed by means of the connection between the plurality of peripherally positioned grooves 45*a* of the inlet flange 45 and the plurality of peripherally positioned grooves 10*a*, 10*b* of the expansion chamber 10.

Subsequently, the heating tower 20 is connected concentrically to the external surface of the expansion chamber 10, in such a way that this is capable of transmitting thermal energy to the interior of the aforesaid chamber 10.

The outlet flange 46 is then connected fluidly and mechanically to the distribution chamber of inlet gases 51, by means of the connection between the plurality of peripherally positioned grooves 46*a* of the flange 46 and the plurality of cavities of the distribution chamber of inlet gases 51. It can be observed that this fluidic connection is established so that the inlet and outlet ducts 41*a*, 42*a* that are adjacent with each other in the outlet flange 46 connect fluidly by means of the cavities of the distribution chamber of inlet gases 51, in such a way that the flow of gases 201 flow from one duct to the other.

It is important to highlight that only a single inlet duct from the plurality of inlet ducts 41*a* remains disconnected fluidly from the other ducts in the outlet flange 45. This is because the single inlet duct from the plurality of inlet ducts 41*a* is connected fluidly to the input 51*a* of the distribution chamber of inlet gases 51, the input 51*a* is subsequently connected fluidly to the external source 200 to receive the gases 201.

Similarly, the expansion chamber 10 is connected fluidly and mechanically to the distribution chamber of outlet gases 52. It can be observed that this fluidic connection is established so that the inlet and outlet ducts 41*a*, 42*a* that are adjacent with each other in the expansion chamber 10 connect fluidly by means of the connection between the plurality of peripherally positioned grooves 10*c*, 10*d* and the plurality of cavities of the distribution chamber of outlet gases 52, in such a way that the flow of gases 202 flow from one duct to the other.

It is important to highlight that only a single outlet duct from the plurality of outlet ducts 42*a* remains disconnected fluidly from the other ducts in the expansion chamber 10. This is because the single outlet duct from the plurality of outlet ducts 42*a* is connected fluidly to the output 52*a* of the distribution chamber of outlet gases 52, the output 52*a* is subsequently connected fluidly to the mechanical energy generating device 300 that will use the optimized gases 202.

Furthermore, it is noted that all the above elements are concentrically and operatively connected to the external casing 50, the latter having as objective the sealing of all the elements that compose the device to optimize the gases for the production of clean energy 1. The external casing 50 in conjunction with the distribution chambers of inlet and outlet gases 51, 52 allows a perfect hermetic seal in relation to the exterior environment, in such a way that no foreign body can enter and none of the optimized gases 201, 202 can escape from the device 1. This characteristic allows a significantly high performance from the device 1 to be coupled to the external source 200 and to mechanical energy generating device 300.

Additionally, the device to optimize gases for the production of clean energy 1 can comprise of explosion proof check valves (not shown).

Once the device to optimize gases for the production of clean energy 1 is assembled/sealed, it can be observed that the set of inlet ducts 41 establish the fluidic communication with the expansion chamber 10 and the thermal communication with the heating tower 20, the expansion chamber 10 establishes a fluidic communication with the set of outlet ducts 42, the set of outlet ducts 42 establishes a fluidic communication with the set of inlet ducts 41.

The gases 201 from an external source 200 are injected into the single inlet duct from the plurality of inlet ducts 41*a*, through the input 51*a* of the distribution chamber of inlet gases 51, the gases 201 alternately establish flows between the inlet ducts 41*a* of the set of inlet ducts 41 and the outlet ducts 42*a* of the set of outlet ducts 42 and vice-versa.

It can be observed that the gases 201, that flow through the inlet ducts 41*a*, establish a maximum interaction with the maximum number of magnetic fields 35 of variable intensity, orientation, direction and polarity generated by the bars 31 of the magnetic nucleus 30, in such a way that coherent beams of flow of gases 201, in particular oxyhydrogen and ionized airs, are formed. This interaction and intensification of the maximum number of magnetic fields allows an efficient acceleration of the hydrogen atoms and ions of oxygen and argons contained in the ionized air.

During the operation, it can be observed that the dynamic expansion begins with the passage of the gases 201 through the plurality of inlet and outlet ducts 41*a*, 42*a* and, subsequently, through the smaller diameter orifices of the expansion chamber 10. This passage allows the acceleration of the movement of the gas molecules 201. When passing through the orifices, the gases 201 enter the expansion chamber with a larger diameter and volume, where their molecules are once again conducted to the heating tower 20 where they are heated.

Subsequently, the gas molecules 201 continue to flow through the ducts 41*a*, 42*a* and flow through another orifice where once again they are submitted to the same process of acceleration, expansion and exchange of heat, and thereby successively until their output.

In relation to the thermal expansion, it can be observed that when the oxyhydrogen passes through the orifice that is in the dynamic expansion chamber 10, this is heated to approximately 60° C., in such a way that both the molecules of hydrogen and those of the oxygen, which are mixed together at this time, are exposed to thermal and volumetric gain, since the volume of the two elements increases with the heating. This stage repeats itself several times during the process until the output.

In relation to the magnetic exposure, it can be observed that the hydrogen atoms have their orbits + and − determined by the electrostatic force and the radius of this orbit defines their level of potential energy stored in the electrons of the atom with an absorption of energy in the increase or release of energy in the reduction of the radius of the orbit of the electron in order that the greater the magnetic action on this orbit, the greater the reduction of its radius and, as a consequence, the increase of release of potential energy stored in the electrons in each one of these orbits. For this purpose the gases 201 pass countless times through the plurality of inlet and outlet ducts 41*a*, 42*a* and through the orifices in the dynamic expansion chambers 10. For each expansion, the orbits pass through 42 magnetic fields of variable intensity, orientation, direction and polarity distributed in three bars 31 with 14 fields (clusters) each, which are housed in the magnetic nucleus 30 of the device 1 that is the object of the present invention. To guarantee the efficiency of the effect, the hydrogen atoms and the ions of oxygen and argon contained in the ionized air are accelerated, which promotes the reduction of the radii of the orbits of the electrons of the hydrogen atoms that allows the release of potential energy from the electrons and a corresponding increase of kinetic energy from the nuclei of the molecule of the gases 201.

Essentially, the optimized gases flow through the expansion chamber 10 and the heating tower 20, in such a way that the gases 202 reduce their pressure and increase their volume and temperature. With a reduced pressure, greater volume and temperature the gases 202, in particular and, in a preferential configuration, the oxyhydrogen do not return to their liquid form, it is possible to proceed with the process of magnetic and molecular reorganization and polarization of the gases 201.

After the passage through the expansion chamber 10 and the heating tower 20, the gases 202 return by means of the outlet ducts 42*a* to the distribution chamber of outlet gases 52 which allows the flow of gases 202 to return to the inlet ducts 41*a* and for the above process to be restarted.

The process of constant acceleration of the hydrogen atoms and ions of oxygen and argons contained in the air of the gases 201, 202, causing the reduction of pressure, increase of volume and temperature and return of the gases composed of hydrogen atoms and ions of oxygen and argons contained in the ionized air is performed at least 6 times.

After the above stages have been performed at least 6 times, it can be observed that the optimized gases 202 flow to a single outlet duct from the plurality of outlet ducts 42*a* and, subsequently, to the output 52*a* of the distribution chamber of outlet gases 52 used by the mechanical energy generating device 300.

Based on the foregoing, it can be observed that the essential stages of the above method can be viewed below:

- to arrange sets of inlet and outlet ducts 41, 42 adjacently around an external surface of a magnetic nucleus 30;
- to establish a fluidic communication between the set of inlet ducts 41 with an expansion chamber 10 and a thermal communication with a heating tower 20;
- to establish a fluidic communication between the expansion chamber 10 and the set of outlet ducts 42;
- to establish a fluidic communication between the set of outlet ducts 42 and the set of inlet ducts 41;
- to admit gases 201 into the set of inlet ducts 41;
- to establish flows of gases 201 alternately between inlet ducts 41*a* and outlet ducts 42*a* and vice-versa, in such a way to expand the gases dynamically 201;
- to expand the gases 201 thermally to each flow between the inlet ducts 41*a* and the outlet ducts 42*a*; and
- to expose the gases 201 magnetically to magnetic fields 35 to each flow between the inlet ducts 41*a* and the outlet ducts 42*a* and vice-versa.

As extensively described in this specification, it is important to highlight once again that depending on the type of mechanical energy generating device 300 or the external source 200, the dimensions of the elements that compose the device 1 can be proportionally re-sized.

Still in reference to the present invention, it can be observed that tests were performed with the following elements:

I) a battery capable of supplying 160 Wh (12 volts/13 amperes) and an electrolytic cell with 66% nominal efficiency fed with water as the external source 200;

II) a device to optimize the efficiency of the combustion of gases for the production of clean energy 1 connected fluidly to the electrolytic cell and receiving ionized air from another source;

III) a power-generator with approximately 30% nominal efficiency as the mechanical energy generating 300;

IV) direct current generator as the current generating device 400; and

V) resistive charges and electrical devices connected electrically to the generator—shower (7.370 Watts (W)), illumination (300 Watts (W)), oven (800 Watts (W)) and drill (750 Watts (W)).

During the tests, it was observed that when applying 160 Wh to initiate the electrolysis process, the electrolytic cell managed to produce energy of 107 Wh and 3.2 grams of hydrogen gas $H_2$. The hydrogen gas $H_2$ flowed to the device 1, where it was mixed with ionized air. After the stages of reorganization and polarization of the gases 201, 202 had been performed at least 6 times, the device 1 managed to increase by 296 times the energy of the injected gases to 31,600 Wh. This energy was supplied to the generator that produced 9,480 Wh to power the charges and electrical devices connected electrically to the generator. It was also observed that the consumption of oxygen, hydrogen and water was significantly reduced and only approximately 28.8 milliliters per hour of water $H_2O$ were necessary to supply energy to these charges and electrical devices through the use of device 1 the object of the present invention.

Based on the above elements, an analysis of gas chromatography with a thermal conductivity detector and traceable to standard masses in accordance with the calibration certificates RBC-INMETRO N° M-49472/14 was performed by the company White Martins Praxair Inc. on Jul. 14, 2016 (Certificate N° 16012). This analysis demonstrated that the device 1 receives 0.2% hydrogen gas $H_2$, 18.2% oxygen gas $O_2$, 63.1% nitrogen gas $N_2$, 0.1% carbon dioxide gas $CO_2$ and readings of less than 0.01% for methane, ethane, ethylene, propane, iso-butane, n-butane and carbon monoxide of (accuracy of the used method).

During its operation of reorganization and polarization of gases, the results demonstrated that the device 1 had in its output 0.3% hydrogen gas $H_2$, 17.5% oxygen gas $O_2$, 62% nitrogen gas $N_2$, 0.1% carbon dioxide gas $CO_2$ and readings of less than 0.01% for methane, ethane, ethylene, propane, iso-butane, n-butane and carbon monoxide of (accuracy of the used method).

The reorganized and polarized gases are then guided to the generator, for the combustion (redox) and generation of mechanical energy. The results of the measurements from the exhaust of the internal combustion engine that drives the generator indicated that 0% hydrogen gas ($H_2$), 17.7 of oxygen gas ($O_2$), 63.7% nitrogen gas ($N_2$), 0.3% carbon dioxide gas ($CO_2$) and readings of less than 0.01% for methane, ethane, ethylene, propane, iso-butane, n-butane and carbon monoxide were emitted by the exhaust of the internal combustion engine of the generators (accuracy of the used method).

Still taking into account the above elements, a mass spectrograph analysis was performed by the Centro de Tecnologia da Informação Renato Archer (CTI) on Oct. 30, 2016, with service order O 14/0562 and signed by Msc. Thebano Emilio de Almeida Santos (Sr. Tecnologist—Physicist). This analysis used a residual gas analyzer, which analyzes gases contained in a high vacuum system (approximately $2\times10^{-7}$ torr/$266.65\times10^{-7}$ Pa), the gas being collected by an ampoule and subsequently injected into this system through a pre-chamber with defined volume and with a controlled flow. This analysis demonstrated that the gases generated by the device that is the object of the present invention have a low atomic mass, with a preference for atmospheric air ($N_2$, $O_2$, $CO_2$, Argon and water vapor).

The results of the measurements in the entrance of the device 1 that is the object of the present invention demonstrated that it receives 30.4% atmospheric air ($N_2$, $O_2$, $CO_2$ and Argon), 29.2% hydrogen gas $H_2$ and 40.4% water vapor.

During its operation of reorganization and polarization of gases, the results demonstrated that in its output the device 1 had 19.8% atmospheric air ($N_2$, $O_2$, $CO_2$ and Argon), 75.4% hydrogen gas $H_2$, 4.8% water vapor and 0.1% hydrochloric gas.

The reorganized and polarized gases are then guided to the generator, for the combustion (redox) and generation of mechanical energy. The results of the measurements from the exhaust of the internal combustion engine that drives the generator demonstrate the presence of 21.4% atmospheric air ($N_2$, $O_2$, $CO_2$ and Argon), 31.6% hydrogen gas $H_2$, 46.7% water vapor and 0.2% hydrochloric gas Within the accuracy of the equipment used in the analyses of the above gases (0.05%) it was not possible to detect the presence of carbon monoxide (CO) and carbon dioxide ($CO_2$) in excess of that usually expected in the atmospheric air or methane. It is important to highlight that the ampoules used in the above tests had a saturated value of partial pressure ($7.0\times10^{-7}$ torr/$933.25\times10^{-7}$ Pa) for several atomic masses. Furthermore, within the mass detection limit of the equipment, which was 200 units of atomic mass, it was not possible to detect the presence of fossil fuels. This can also be confirmed by the absence of signs of carbon monoxide (atomic mass 28) and carbon dioxide (atomic mass 44).

These tests clearly demonstrate that the use of hydrogen gas $H_2$ as a source of energy has the potential of responding to the urgent search for an alternative source of clean, low cost and abundant energy. As well evidenced, the process of combustion/redox of the hydrogen performed in the present invention does not result in the emission of polluting gases. This process is an alternative source of clean energy and viable for use in the most diverse areas as highlighted previously.

The example of preferred embodiment having been described, it should be understood that the scope of the present invention extends to other possible variations, and is limited only by the content of the claims, including the possible equivalents.

The invention claimed is:

1. A device to optimize the efficiency of the combustion of gases for the production of clean energy (1), the device comprising: a magnetic nucleus (30); and a plurality of inlet ducts (41*a*) and a plurality of outlet ducts (42*a*), wherein: the plurality of inlet and outlet ducts (41*a*, 42*a*) are positioned relative to one another such that respective ones of the plurality inlet ducts (41*a*) are only adjacent respective ones of the plurality of outlet ducts (42*a*), the respective ones of the plurality of inlet and outlet ducts (41*a*, 42*a*) that are adjacent each other sequentially and fluidly connect with each other, the plurality of inlet and outlet ducts (41*a*, 42*a*) are configured to receive gases (201), the gases (201) flowing sequentially through the respective ones of the plurality of inlet and outlet ducts (41*a*, 42*a*) that are adjacent each other such that the gas flow alternates between respective ones of the plurality of inlet and outlet ducts (41*a*, 42*a*) the magnetic nucleus (30) is configured to generate and to expose the gases (201) within the inlet and outlet ducts (41*a*, 42*a*) to magnetic fields (35), the sequential flow through the plurality of inlet and outlet ducts (41*a*, 42*a*) and the exposure to magnetic fields (35) is configured for promoting dynamic expansion and magnetic exposure of the gases, wherein the plurality of inlet and outlet ducts (41*a*, 42*a*) extend adjacently around the external surface of the magnetic nucleus (30).

2. The device according to claim 1, wherein each one of the plurality of inlet and outlet ducts (41*a*, 42*a*) has at least three revolutions of 360 degrees around the external surface of the magnetic nucleus (30).

3. The device according to claim 1, wherein the magnetic fields (35) interact perpendicularly to the movement of the atoms of the gases (201).

4. The device according to claim 1, wherein the magnetic nucleus (30) has three magnetic bars (31), the bars (31) being provided with magnetic elements (31*a*) of magnets of rare earth metals and gaps (31*b*) arranged in the interior of the magnetic bars (31) and being configured to generate magnetic fields of variable intensity, orientation, direction and polarity.

5. The device according to claim 4, wherein the magnetic elements (31*a*) are made from an alloy of neodymium-iron-boron Nd—Fe—B.

6. The device according to claim 4, wherein each bar (31) comprises 32 magnetic elements (31*a*).

7. The device according to claim 4, wherein the magnetic bars (31) are arranged to form an angle of approximately 120° between the centers of the bars (31).

8. The device according to claim 1, wherein the dynamic expansion occurs through the alternation of flows between the adjacent ones of the plurality of inlet and outlet ducts (41*a*, 42*a*) and when the gases (201) further flow through an expansion chamber (10) provided with ducts having a cross-section different than that of the plurality of inlet and outlet ducts (41*a*, 42*a*).

9. The device according to claim 1, wherein thermal expansion further occurs through the alternation of flows between the plurality of inlet and outlet ducts (41*a*, 42*a*) when the gases (201) flow through a heating tower (20).

10. The device according to claim 9, wherein the heating tower (20) is connected concentrically to the external surface of the expansion chamber (10).

11. The device according to claim 9, wherein the heating tower (20) is configured to operate in a range between 55° C. and 65° C.

12. The device according to claim 9, wherein the heating tower (20) is an annular electric resistor.

13. The device according to claim 9, wherein the dynamic and thermal expansions cause a reduction of pressure and increase of the volume and temperature of the gases (201, 202).

14. The device according to claim 9, wherein the dynamic and thermal expansions of the gases (201, 202) are performed at least 6 times by the device (1).

15. The device according to claim 1, wherein the gases (201) are a mixture of oxyhydrogen and ionized air.

16. The device according to claim 15, wherein oxyhydrogen is produced by an electrolytic cell (200).

17. The device according to claim 1, wherein the optimized gases (202) are used by a mechanical energy generating device (300).

18. The device according to claim 1, wherein the plurality of inlet and outlet ducts (41*a*, 42*a*) form respective sets of inlet and outlet ducts (41, 42).

19. The device according to claim 18, wherein the gases (201) are received by a single inlet duct of the inlet ducts (41*a*).

20. The device according to claim 19, wherein optimized gases (202) flow to a single outlet duct of the outlet ducts (42*a*).

21. A device to optimize the efficiency of the combustion of gases for the production of clean energy (1), the device comprising: an expansion chamber (10); a heating tower (20); a magnetic nucleus (30); a set of inlet ducts (41); and a set of outlet ducts (42), wherein: the sets of inlet and outlet ducts (41, 42) are provided with a plurality of inlet and outlet ducts (41*a*, 42*a*) that extend adjacently around the external surface of the magnetic nucleus (30), the sets of inlet and outlet ducts (41, 42) being concentric to the magnetic nucleus (30), the set of inlet ducts (41) establishes a fluidic communication with the expansion chamber (10) and a thermal communication with the heating tower (20), the expansion chamber (10) establishes a fluidic communication with the set of outlet ducts (42), and the set of outlet ducts (42) establishes a fluidic communication with the set of inlet ducts (41), in such a way that: the plurality of inlet and outlet ducts (41*a*, 42*a*) are positioned relative to one another such that respective ones of the plurality inlet ducts (41*a*) are only adjacent respective ones of the plurality of outlet ducts (42*a*), the respective ones of the plurality of inlet and outlet ducts (41*a*, 42*a*) that are adjacent each other sequentially and fluidly connect with each other, the plurality of inlet and outlet ducts (41*a*, 42*a*) receive gases (201), the gases (201) flowing sequentially through the respective ones of the plurality of inlet and outlet ducts (41*a*, 42*a*) that are adjacent each other such that the gas flow alternates between respective ones of the plurality of inlet and outlet ducts (41*a*, 42*a*), the magnetic nucleus (30) being configured to generate and to expose the gases (201) within the inlet and outlet ducts (41*a*, 42*a*) to magnetic fields (35), and the sequential flow through the plurality of inlet and outlet ducts (41*a*, 42*a*) promotes dynamic expansion of the gases (201) when the gases (201) flow through the expansion chamber (10), thermal expansion of the gases (201) when the gases (201) flow through the heating tower (20), and exposure of the gases (201) to magnetic fields (35) generated by the magnetic nucleus (30), wherein the plurality of inlet and outlet ducts (41*a*, 42*a*) extend adjacently and helically around the external surface of the magnetic nucleus (30).

22. A system to optimize the efficiency of the combustion of gases for the production of clean energy, the system comprising: a device to optimize the efficiency of the combustion of gases for the production of clean energy (1); and a mechanical energy generating device (300), wherein: the device to optimize the efficiency of the combustion of gases for the production of clean energy (1) is provided with a plurality of inlet and outlet ducts (41*a*, 42*a*) and a magnetic nucleus (30), the plurality of inlet and outlet ducts (41*a*, 42*a*) are positioned relative to one another such that respective ones of the plurality inlet ducts (41*a*) are only adjacent respective ones of the plurality of outlet ducts (42*a*), the respective ones of the plurality of inlet and outlet ducts (41*a*, 42*a*) that are adjacent each other sequentially and fluidly connect with each other, the plurality of inlet and outlet ducts (41*a*, 42*a*) are configured to receive gases (201), the gases (201) flowing sequentially through the respective ones of the plurality of inlet and outlet ducts (41*a*, 42*a*) that are adjacent each other such that the gas flow alternates between respective ones of the plurality of inlet and outlet ducts (41*a*, 42*a*), the magnetic nucleus (30) being configured to generate and to expose the gases (201) within the inlet and outlet ducts (41*a*, 42*a*) to magnetic fields (35), the sequential flow through the plurality of inlet and outlet ducts (41*a*, 42*a*) and the exposure to the magnetic fields (35) promote dynamic expansion and magnetic exposure of the gases (201), and optimized gases (202) flow to the mechanical energy generating device (300), wherein the plurality of inlet and outlet ducts (41*a*, 42*a*) extend adjacently and helically around the external surface of the magnetic nucleus (30).

23. A system to optimize the efficiency of the combustion of gases for the production of clean energy, the system comprising: a device to optimize the efficiency of the combustion of gases for the production of clean energy (1); and a mechanical energy generating device (300), wherein: the device to optimize the efficiency of the combustion of gases for the production of clean energy (1) is provided with sets of inlet and outlet ducts (41, 42) that have a plurality of respective inlet and outlet ducts (41*a*, 42*a*) that extend adjacently around an external surface of a magnetic nucleus (30), the sets of inlet and outlet ducts (41, 42) being concentric to the magnetic nucleus (30), the set of inlet ducts (41) establishes a fluidic communication with an expansion chamber (10) and a thermal communication with a heating tower (20), the expansion chamber (10) establishing a fluidic communication with the set of outlet ducts (42), and the set of outlet ducts (42) establishing a fluidic communication with the set of inlet ducts (41), in such a way that: the plurality of inlet and outlet ducts (41*a*, 42*a*) are positioned relative to one another such that respective ones of the plurality inlet ducts (41*a*) are only adjacent respective ones of the plurality of outlet ducts (42*a*), the respective ones of the plurality of inlet and outlet ducts (41*a*, 42*a*) that are adjacent each other sequentially and fluidly connect with each other, the plurality of inlet and outlet ducts (41*a*, 42*a*) receive gases (201), the gases (201) flowing sequentially through the respective ones of the plurality of inlet and outlet ducts (41*a*, 42*a*) that are adjacent each other such that the gas flow alternates between respective ones of the plurality of inlet and outlet ducts (41*a*, 42*a*), the magnetic nucleus (30) being configured to generate and to expose the gases (201) within the inlet and outlet ducts (41*a*, 42*a*) to magnetic fields (35), the sequential flow through the plurality of inlet and outlet ducts (41*a*, 42*a*) promote dynamic expansion of the gases (201) when the gases (201), flow through the expansion chamber (10), thermal expansion of the gases (201) when the gases (201) flow through the heating tower (20), and exposure of the gases (201) to magnetic fields (35) generated by the magnetic nucleus (30), and optimized gases (202) flow to the mechanical energy generating device (300), wherein the plurality of inlet and outlet ducts (41*a*, 42*a*) extend adjacently and helically around the external surface of the magnetic nucleus (30).

24. A method to optimize the efficiency of the combustion of gases for the production of clean energy, the method comprising the steps of: establishing flows of gases (201) sequentially through a plurality of inlet ducts (41*a*) and outlet ducts (42*a*) in such a way to expand dynamically the gases (201), the plurality of inlet and outlet ducts (41*a*, 42*a*) being positioned relative to one another such that respective ones of the plurality inlet ducts (41*a*) are only adjacent respective ones of the plurality of outlet ducts (42*a*), such that the sequential flow alternates between respective inlet and outlet ducts (41*a*, 42*a*); expanding the gases (201) thermally to flow between the inlet ducts (41*a*) and the outlet ducts (42*a*); and exposing the gases (201) within the inlet ducts (41*a*) and the outlet ducts (42*a*) magnetically to magnetic fields (35), wherein the plurality of inlet and outlet ducts (41*a*, 42*a*) extend adjacently and helically around the external surface of the magnetic nucleus (30).

25. A method to optimize the efficiency of the combustion of gases for the production of clean energy, the method comprising the steps of: arranging sets of inlet and outlet ducts (41, 42) adjacently around an external surface of a magnetic nucleus (30), the sets of inlet and outlet ducts each comprising a plurality of inlet and outlet ducts (41*a*, 42*a*), respectively, the plurality of inlet and outlet ducts (41*a*, 42*a*) being positioned relative to one another such that respective ones of the plurality inlet ducts (41*a*) are only adjacent respective ones of the plurality of outlet ducts (42*a*); establishing a fluidic communication between the set of inlet ducts (41) with an expansion chamber (10) and a thermal communication with a heating tower (20); establishing a fluidic communication between the expansion chamber (10) and the set of outlet ducts (42); establishing a fluidic communication between the set of outlet ducts (42) and the set of inlet ducts (41); injecting gases (201) into the set of inlet ducts (41); establishing flows of gases (201) sequentially through the respective ones of the plurality of inlet and outlet ducts (41*a*, 42*a*) that are adjacent each other such that the gas flow alternates between respective ones of the plurality of inlet ducts (41*a*) and outlet ducts (42*a*), in such a way to expand dynamically the gases (201); expanding the gases (201) thermally to flow between the inlet ducts (41*a*) and the outlet ducts (42*a*); and exposing the gases (201) within the inlet ducts (41*a*) and the outlet ducts (42*a*) magnetically to magnetic fields (35), wherein the plurality of inlet and outlet ducts (41*a*, 42*a*) extend adjacently and helically around the external surface of the magnetic nucleus (30).

* * * * *